US010677520B2

(12) United States Patent
Choi et al.

(10) Patent No.: US 10,677,520 B2
(45) **Date of Patent: *Jun. 9, 2020**

(54) REFRIGERATOR

(71) Applicant: SAMSUNG ELECTRONICS CO., LTD., Suwon-si, Gyeonggi-do (KR)

(72) Inventors: June Hyuck Choi, Seongnam-si (KR); Byeong Soo Kim, Seoul (KR); Cheol Woong Seo, Seoul (KR); Hyun-Il Lee, Seoul (KR); Sang Woon Jeon, Seoul (KR); Yeon Jin Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/219,397

(22) Filed: Dec. 13, 2018

(65) Prior Publication Data

US 2019/0120545 A1 Apr. 25, 2019

Related U.S. Application Data

(63) Continuation of application No. 15/650,373, filed on Jul. 14, 2017, now Pat. No. 10,174,993.

(30) Foreign Application Priority Data

Jul. 14, 2016 (KR) ..... 10-2016-0089071

(51) Int. Cl.
*F25D 25/02* (2006.01)
*F25D 23/00* (2006.01)
*F25D 23/02* (2006.01)

(52) U.S. Cl.
CPC ..... *F25D 25/025* (2013.01); *F25D 23/00* (2013.01); *F25D 23/028* (2013.01); (Continued)

(58) Field of Classification Search
CPC ..... F25D 25/02; F25D 25/027; F25D 25/024; F25D 2325/021
See application file for complete search history.

(56) References Cited

U.S. PATENT DOCUMENTS 2,352,345 A 6/1944 Rundell
3,859,932 A * 1/1975 Armstrong ..... A47B 96/025 108/75

(Continued)

FOREIGN PATENT DOCUMENTS

CN 101004315 7/2007
CN 102735003 10/2012

(Continued)

OTHER PUBLICATIONS

European Search Report issued in European Patent Application No. 17179469.6 dated Oct. 30, 2017 (7 pages).

(Continued)

*Primary Examiner* — Daniel J Rohrhoff
(74) *Attorney, Agent, or Firm* — Staas & Halsey LLP

(57) ABSTRACT

A refrigerator having improved space utilization includes a main body, a storage room formed inside of the main body, a center frame provided at the center of the storage room to be spaced apart from both side walls of the storage room and having a guide elongated in a front-rear direction of the storage room and a plurality of shelves detachably coupled to the guide so as to be movable along the guide, the plurality of shelves including a first shelf and a second shelf positioned under the first shelf while the second shelf moving along the same guide as the first shelf in an inverted state.

10 Claims, 21 Drawing Sheets

(52) U.S. Cl.
CPC ..... *F25D 25/024* (2013.01); *F25D 2323/021* (2013.01); *F25D 2325/021* (2013.01)

(56) References Cited

U.S. PATENT DOCUMENTS

| | | | | |
|---|---|---|---|---|
| 4,620,489 | A | 11/1986 | Albano | |
| 5,813,741 | A | 9/1998 | Fish | |
| 8,376,483 | B2 | 2/2013 | Jung | |
| 8,403,438 | B2 | 3/2013 | Park | |
| 8,777,341 | B2 * | 7/2014 | Amaral | F25D 25/024 312/408 |
| 8,814,287 | B2 * | 8/2014 | Jang | F25D 25/024 108/17 |
| 8,840,205 | B2 | 9/2014 | Chellappan | |
| 9,103,582 | B2 | 8/2015 | Nash | |
| 9,127,877 | B2 | 9/2015 | Lee | |
| 9,335,089 | B1 * | 5/2016 | Gossens | F25D 25/024 |
| 9,459,040 | B2 | 10/2016 | Kim | |
| 9,574,820 | B2 * | 2/2017 | Lee | F25D 25/02 |
| 10,174,993 | B2 * | 1/2019 | Choi | F25D 23/00 |
| 2003/0020387 | A1 | 1/2003 | Wing | |
| 2010/0109498 | A1 * | 5/2010 | Ramm | F25D 23/067 312/408 |
| 2011/0001415 | A1 * | 1/2011 | Park | F25D 25/02 312/408 |
| 2014/0239792 | A1 * | 8/2014 | Chellappan | F25D 23/067 312/408 |
| 2014/0375199 | A1 * | 12/2014 | Lee | F25D 25/024 312/404 |
| 2015/0153099 | A1 * | 6/2015 | Nash | F25D 25/024 312/408 |
| 2015/0300726 | A1 | 10/2015 | Yi et al. | |

FOREIGN PATENT DOCUMENTS

| | | | |
|---|---|---|---|
| CN | 102889744 | | 1/2013 |
| EP | 2 818 814 | A2 | 12/2014 |
| EP | 2 818 814 | A3 | 4/2015 |
| JP | 8-35765 | | 2/1996 |
| JP | 2004-85052 | | 3/2004 |
| KR | 10-2007-0070986 | | 8/2004 |
| KR | 10-2008-0023564 | | 3/2008 |
| KR | 10-2011-0002589 | | 1/2011 |
| KR | 10-2015-0105868 | | 9/2015 |

OTHER PUBLICATIONS

Australian Office Action dated Apr. 4, 2018 issued in corresponding Australian Patent Application No. 2017204476 (3 pages).
Australian Patent Office issued Notice of acceptance for patent application dated Sep. 3, 2018 in corresponding Australian Patent Application No. 2017204476 (3 pages).
European Patent Office issued Communication under Rule 71(3) EPC in European Application No. 17 179 469.6-1009 dated Aug. 30, 2018 (53 pages).
Non-final Office Action dated Feb. 6, 2018 in U.S. Appl. No. 15/650,373 (18 pages).
Notice of Allowance dated Aug. 30, 2018 in U.S. Appl. No. 15/650,373 (10 pages).
Corrected Notice of Allowance dated Dec. 3. 2018 in U.S. Appl. No. 15/650,373 (7 pages).
U.S. Appl. No. 15/650,373, filed Jul. 14, 2017, Jun. Hyuck Choi et al., Samsung Electronics Co., Ltd.
Extended European Search Report dated Apr. 1, 2019 in corresponding European Patent Application No. 18215622.4 (5 pages).
Chinese Office Action dated Jun. 21, 2019 in corresponding Chinese Patent Application No. 201710574049.1.

* cited by examiner

REFRIGERATOR

CROSS-REFERENCE TO RELATED APPLICATION

This application is a Continuation of Ser. No. 15/650,373, filed Jul. 14, 2017 and claims the priority benefit of the Korean Patent Application No. 10-2016-0089071, filed on Jul. 14, 2016, in the Korean Intellectual Property Office, the disclosure of which is incorporated herein by reference.

BACKGROUND

1. Field

Embodiments of the disclosure relate to a refrigerator, and more particularly, to a refrigerator capable of making better use of space.

2. Description of the Related Art

In general, a refrigerator has a main body, a storage room provided inside the main body, and a cool air supply apparatus for supplying cool air to the storage room to keep food fresh.

The storage room is provided with shelves to place food thereon. Generally, in a French Door Refrigerator (FDR) type refrigerator having wide storage space in a left-right direction, separate shelves are provided in the left and right space of the storage room, respectively, and the shelves are supported on the rear wall of the main body.

The shelves are called cantilever shelves because the shelves are supported only on the rear wall of the main body. At the rear portions of the cantilever shelves, hooks are formed, and in the rear wall of the main body, catching holes to be coupled with the hooks are arranged vertically at different heights. Therefore, the heights of the cantilever shelves can be adjusted by engaging the hooks with the desired catching holes.

The cantilever shelves can be fixed on the rear wall of the main body by coupling the hooks with the catching holes, or separated from the storage room by decoupling the hooks from the catching holes. However, it is impossible to move the cantilever shelves back and forth. Also, since the hooks of the cantilever shelves engaged with the catching holes of the main body are formed at the rear portions of the cantilever shelves, it is not easy to attach/detach the cantilever shelves to/from the rear wall of the main body.

SUMMARY

It is an aspect of the disclosure to provide a refrigerator having an improved structure for making better use of space of a storage room by arranging shelves or the like freely.

It is another aspect of the disclosure to provide a refrigerator having an improved structure for facilitating detachment and attachment of shelves or the like.

It is another aspect of the disclosure to provide a refrigerator having an improved structure allowing back-and-forth movement of shelves or the like.

In accordance with an aspect of the disclosure, a refrigerator may include a main body, a storage room formed inside of the main body, a center frame provided at the center of the storage room to be spaced apart from both side walls of the storage room and having a guide elongated in a front-rear direction of the storage room and a plurality of shelves detachably coupled to the guide so as to be movable along the guide, the plurality of shelves including a first shelf and a second shelf positioned under the first shelf while the second shelf moving along the same guide as the first shelf in an inverted state.

The plurality of shelves may include a shelf body and a catching portion formed at an edge of the shelf body to be coupled to the guide.

The catching portion may be formed in a part of the edge of the shelf body while elongated in the front-rear direction of the storage room.

The catching portion may be formed in a part of the edge of the shelf body so as to face downward of the storage room.

When the second shelf is turned over and positioned under the first shelf, the catching portion of the first shelf may face downward of the storage room, the catching portion of the second shelf may face upward of the storage room and the catching portion of the first shelf and the catching portion of the second shelf may be interfered each other on the guide in the front-rear direction of the storage room.

The center frame may include a support portion at which the guide is formed, and a reinforcing portion connected to the support portion to reinforce the support portion and disposed at the lower portion of the support portion.

The guide may be integrally formed with the support portion so as to protrude toward the side walls of the storage room.

In accordance with an aspect of the disclosure, a refrigerator may further include sidewall frames provided on the both side walls of the storage room so as to correspond to the center frame and having a guide protruding toward the center frame to guide a movement of the plurality of shelves together with the guide of the center frame.

In accordance with an aspect of the disclosure, a refrigerator may further include a rear wall frame provided on a rear wall of the storage room to connect the center frame and each of the sidewall frames in a lateral direction of the storage room.

In accordance with an aspect of the disclosure, a refrigerator may further include a bead protruding from both side walls of the storage room to correspond to the center frame and guiding a movement of the plurality of shelves together with the guide of the center frame.

In accordance with an aspect of the disclosure, a refrigerator may include a main body, a storage room formed inside of the main body, a center frame provided at the center of the storage room to be spaced apart from both side walls of the storage room and having a guide elongated in a front-rear direction of the storage room, a plurality of accommodating spaces partitioned by the center frame, each of the plurality of accommodating spaces including a first space and a second space positioned behind the first space in a front-rear direction of the storage room and a plurality of shelves detachably coupled to the guide so as to be movable along the guide, the plurality of shelves including a first shelf positioned in the first space and a second shelf positioned in the second space. The first shelf may be positioned under the second shelf so as to open the first space while the first shelf moving along the same guide as the first shelf in an inverted state.

The first shelf may be positioned in the second space together with the second shelf so that the first space is fully opened.

In accordance with an aspect of the disclosure, a refrigerator may include a main body, a storage room formed inside of the main body, a center frame provided at the center of the storage room to be spaced apart from both side walls of the storage room and having a guide elongated in a front-rear direction of the storage room, the center frame including a first center frame and a second center frame which are disposed in an up-down direction of the storage room, a shelf detachably coupled to the guide of the first center frame so as to be movable along the guide of the first center frame and a containing member detachably coupled to the guide of the second center frame so as to be movable along the guide of the second center frame.

The shelf may include a shelf body and a catching portion formed at a part of an edge of the shelf body to be coupled to the guide of the first center frame.

The containing member may include a basket. The basket may include a casing having an opening and a rail provided on an outer wall of the casing so as to be coupled to the guide of the second center frame.

The opening may be opened or closed by a movement of at least one of the shelf and the basket.

The first center frame may be disposed above the second center frame in the up-down direction of the storage room. The rail may be recessed in the front-rear direction of the storage room at a lower end of the casing such that the opening of the casing is adjacent to the shelf.

The containing member may include a containing tray. The containing tray may include a bottom plate and a side wall provided with a catching portion which is coupled to the guide of the second center frame, bent from the bottom plate and extending to have a height.

The catching portion may be formed at an upper end of the side wall integrally with the side wall.

In accordance with an aspect of the disclosure, a refrigerator may further include sidewall frames provided on the both side walls of the storage room so as to correspond to the center frame and having a guide protruding toward the center frame to guide a movement of the shelf and the containing member together with the guide of the center frame.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
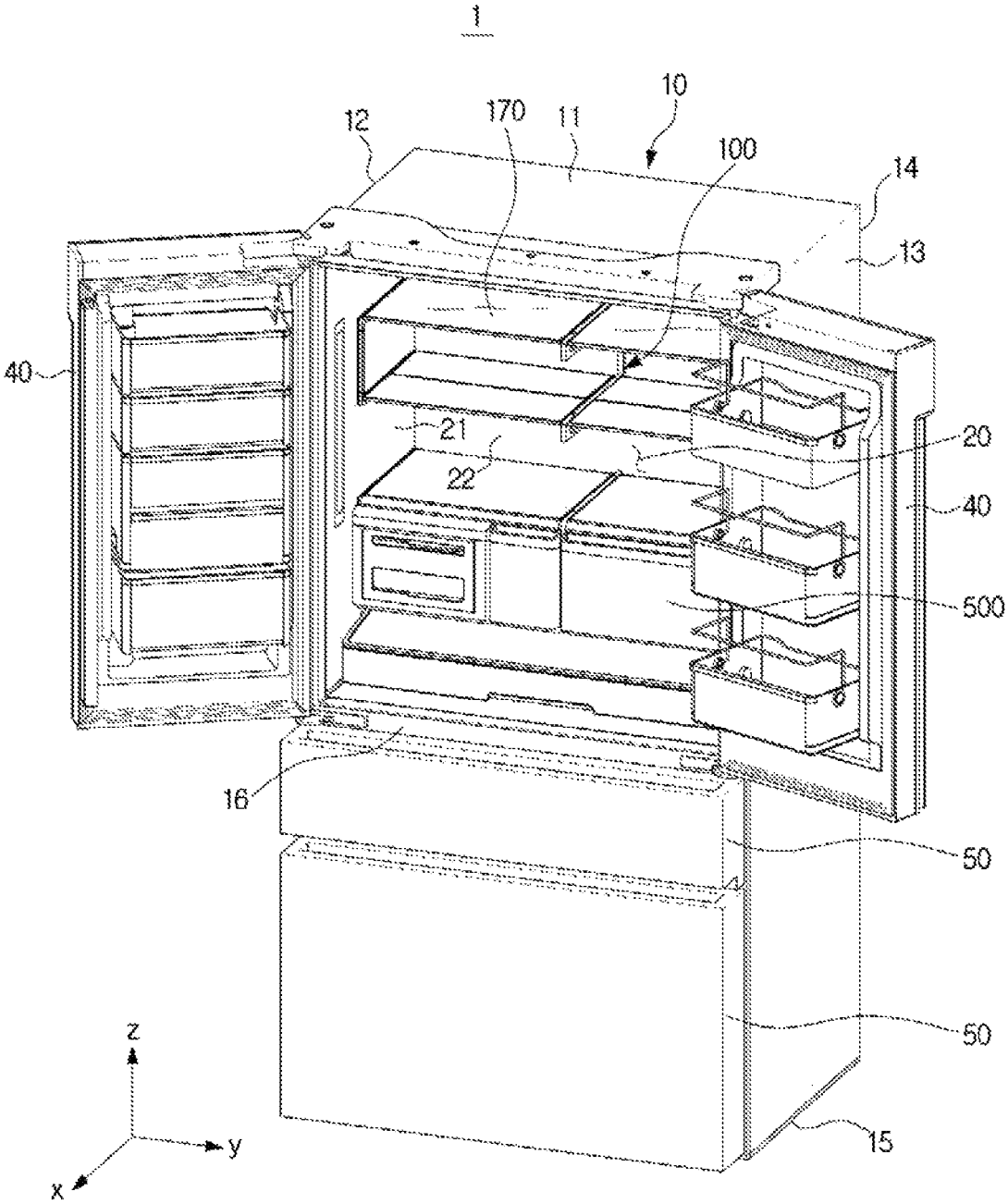
FIG. 1 is a perspective view of a refrigerator in accordance with an embodiment of the disclosure.

Hereinafter, the preferred embodiments of the present disclosure will be described in detail with reference to the accompanying drawings. In the drawings, like reference numerals refer to like elements throughout. Meanwhile, terms, "front end", "rear end", "upper", "lower", "upper end" and "lower end" which will be used in the below description are defined based on the drawings, and the shapes and positions of elements are not limited by the terms.

FIG. 1 is a perspective view illustrating a refrigerator in accordance with an embodiment of the disclosure. Hereinafter, "X" represents a front-rear direction of a storage room, "Y" represents a left-right direction of the storage room, and "Z" represents an up-down direction of the storage room. Herein, the storage room may be a refrigerating chamber 20.

As shown in FIG. 1, the refrigerator 1 may include a main body 10. The main body 10 may form the outer appearance of the refrigerator 1.

The main body 10 may be in the shape of a substantially box whose front side opens. The main body 10 may include an inner case (not shown) forming a plurality of storage rooms 20, an outer case (not shown) coupled with the outer surface of the inner case to form the outer appearance of the refrigerator 1, and an insulating material (not shown) provided between the inner frame and the outer frame.

The main body 10 may further include a top wall 11, a left wall 12, a right wall 13, a rear wall 14, a bottom 15, and a horizontal partition 16 to partition the plurality of storage rooms (20).

The refrigerator 1 may further include a plurality of storage rooms 20. The plurality of storage rooms 20 may be formed in the main body 10. The plurality of storage rooms 20 may include a refrigerating chamber 20 and a freezing chamber (not shown). The plurality of storage rooms 20 may be partitioned into the upper refrigerating chamber 20 and the lower freezing chamber by the horizontal partition 16. The refrigerating chamber 20 and the freezing chamber may each have an open front part to enable a user to put or take food, and the open front parts may be opened or closed by a plurality of doors 40 and 50.

The refrigerator 1 may further include the plurality of doors 40 and 50 provided to open or close the plurality of storage rooms 20. The plurality of doors 40 and 50 may include a plurality of rotating doors 40 and at least one sliding door 50. More specifically, the refrigerating chamber 20 may be opened or closed by the plurality of rotating doors 40 rotatably coupled with the main body 10. The freezing chamber may be opened or closed by the at least one sliding door 50 configured to move in the front-rear direction with respect to the main body 10.

The refrigerator 1 may further include a cold air supply apparatus (not shown). The cold air supply apparatus may supply cool air to the plurality of storage rooms 20. The cold air supply apparatus may include a plurality of devices (not shown) constituting a refrigerating cycle, a blower fan (not shown), etc., and generate cold air to supply it to the refrigerating chamber 20 and the freezing chamber.

The refrigerator 1 may further include a frame 100. The frame 100 may be installed in the plurality of storage rooms 20. More specifically, the frame 100 may be installed inside the refrigerating chamber 20. Details about the frame 100 will be described later.

The refrigerator 1 may further include a plurality of shelves 170. The plurality of shelves 170 may be provided inside the plurality of storage rooms 20 to place food thereon. More specifically, the plurality of shelves 170 may be provided inside the refrigerating chamber 20. Details about the plurality of shelves 170 will be described later.

The refrigerator 1 may further include at least one containing member 500, 600, 710, 720 and 730. The at least one containing member 500, 600, 710, 720 and 730 may be provided inside the plurality of storage rooms 20 to accommodate food. More specifically, the at least one containing member 500, 600, 710, 720 and 730 may be provided inside the refrigerating chamber 20. Details about the at least one containing member 500, 600, 710, 720 and 730 will be described later.

Figure 2:
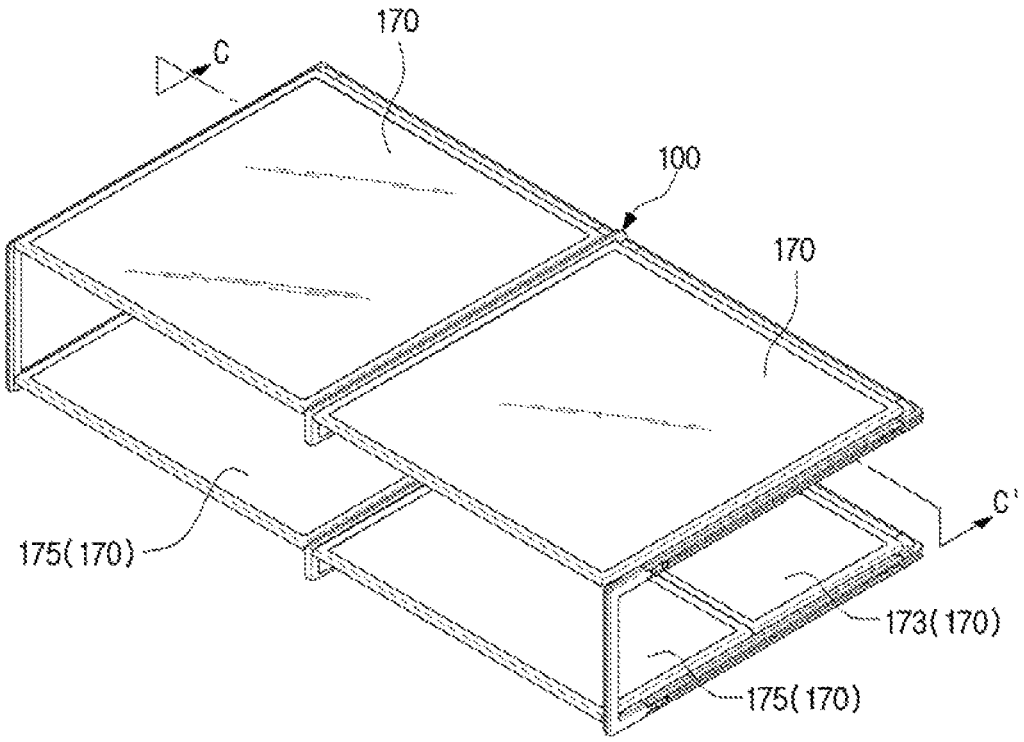
FIG. 2 shows shelves of the refrigerator of FIG. 1 and a frame supporting the shelves.
Figure 3:
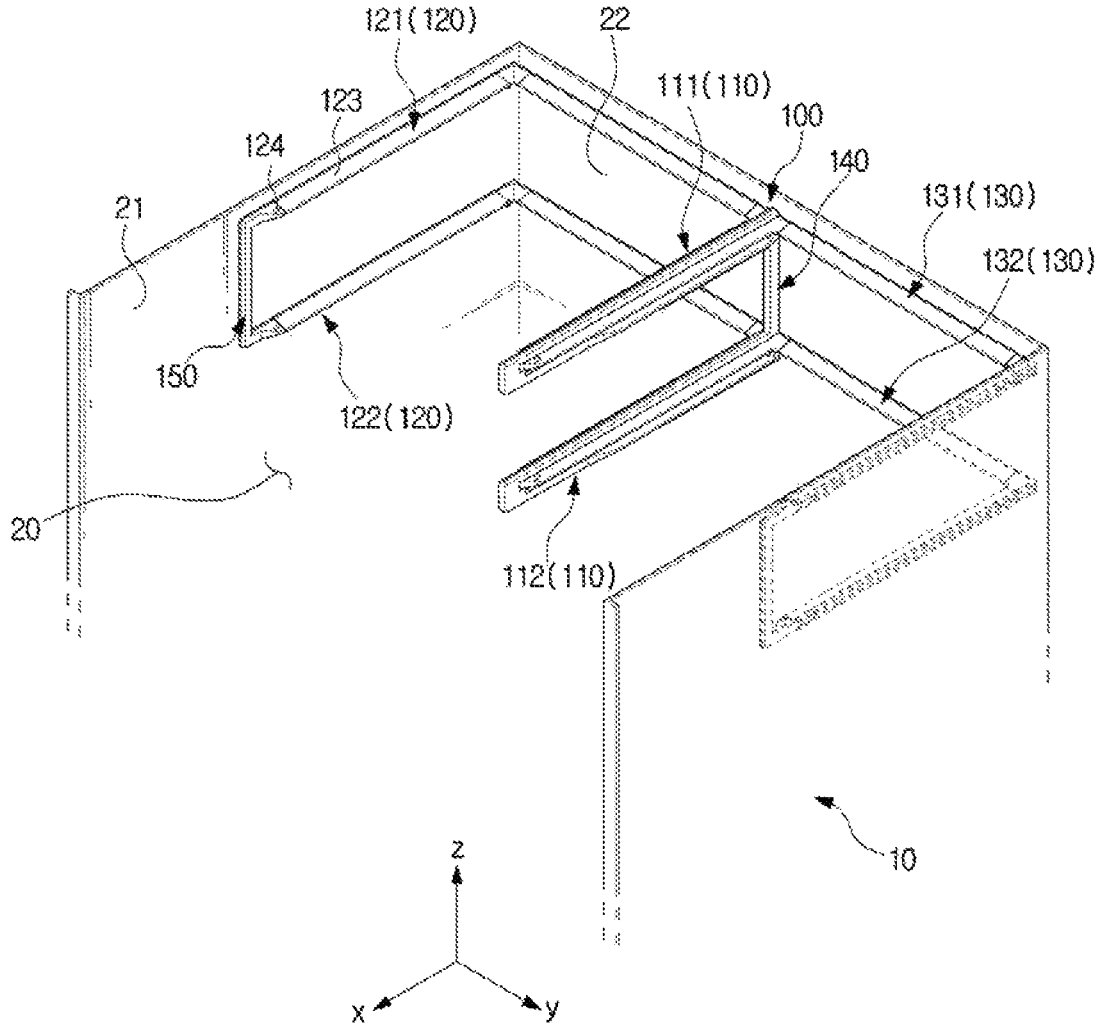
FIG. 3 shows the frame of the refrigerator of FIG. 1.
Figure 4:
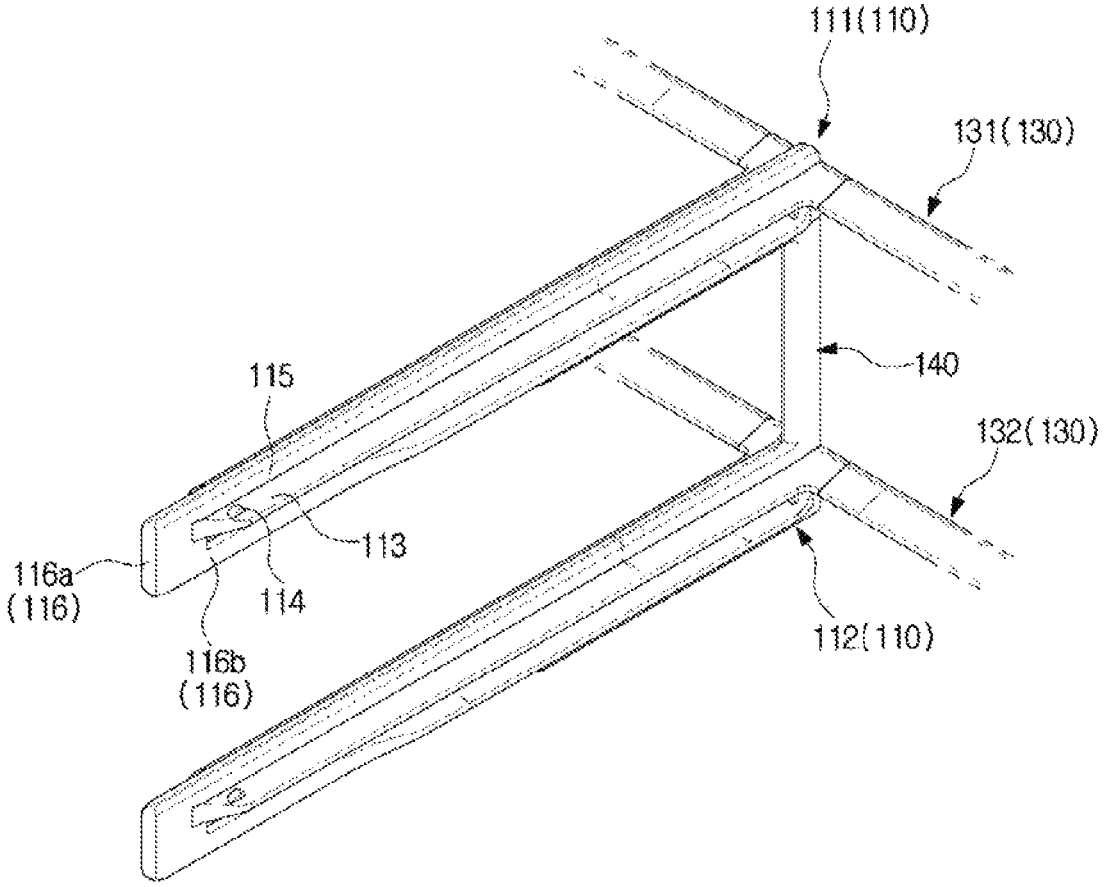
FIG. 4 is an enlarged view illustrating a part of the frame shown in FIG. 3.

FIG. 2 shows shelves of the refrigerator of FIG. 1 and a frame supporting the shelves, FIG. 3 shows the frame of the refrigerator of FIG. 1, and FIG. 4 is an enlarged view illustrating a part of the frame shown in FIG. 3. Hereinafter, reference numerals not denoted in FIGS. 2, 3, and 4 will be able to be understood from the above description with reference to FIG. 1. Also, in the following description, a storage room means the refrigerating chamber 20.

As shown in FIGS. 2 to 4, the refrigerator 1 may further include the frame 100. The frame 100 may be installed inside the storage chamber 20 to support the plurality of shelves 170 and the at least one containing members 500, 600, 710, 720 and 730.

The frame 100 may include a center frame 110. The center frame 110 may be provided at the center of the storage room 20 so as to be spaced apart from both side walls 21 of the storage room 20. The center frame 110 may be fixed at the rear wall 22 of the storage room 20.

The center frame 110 may include a guide 113. The guide 113 may extend in the front-rear direction X of the storage room 20. The guide 113 may include a stopper 114. The stopper 114 may protrude upward. The stopper 114 may be provided at a front end of the guide 113 to restrict the movement of the plurality of shelves 170 and the at least one containing member 500, 600, 710, 720 and 730. More specifically, the stopper 114 can prevent the plurality of shelves 170 and the at least one containing member 500, 600, 710, 720 and 730 moving along the guide 113 from escaping from the storage room 20.

The center frame 110 may further include a support portion 115. The guide 113 may be formed on the support portion 115. The guide 113 may be integrated into the support portion 115 in such a way to protrude toward the side walls 21 of the storage room 20.

The center frame 110 may further include a reinforcing portion 116. The reinforcing portion 116 may function to reinforce the rigidity of the support portion 115. The reinforcing portion 116 may be connected to the support portion 115. The reinforcing portion 116 may be disposed below the support portion 115.

The reinforcing portion 116 may include a horizontal reinforcing portion **116*b* disposed in parallel to the supporting portion 115 below the supporting portion 115. Also, the reinforcing portion 116 may further include a vertical reinforcing portion 116*a* connecting the horizontal reinforcing portion 116*b* to the supporting portion 115. The vertical reinforcing portion 116*a* may connect the horizontal reinforcing portion 116*b* to the support portion 115 in at least one of the front and rear areas of the storage room 20**.

The frame 100 may further include a sidewall frame 120. The sidewall frame 120 may be provided on both side walls 21 of the storage room 20 in correspondence to the center frame 110. The sidewall frame 120 may be fixed on both side walls 21 of the storage room 20.

The sidewall frame 120 may include a guide 123 protruding toward the center frame 110 so as to guide the movement of the plurality of shelves 170 and the at least one containing member 500, 600, 710, 720 and 730 together with the guide 113 of the center frame 110. The guide 123 of the sidewall frames 120 may extend in the front-rear direction X of the storage room 20, like the guide 113 of the center frame 110. The guide 123 of the sidewall frame 120 may include a stopper 124. The stopper 124 disposed on the guide 123 of the sidewall frame 120 may be the same in shape and function as the stopper 114 provided on the guide 113 of the center frame 110, and accordingly, a detailed description thereof will be omitted.

The frame 100 may further include a rear wall frame 130. The rear wall frame 130 may be disposed on the rear wall 22 of the storage room 20 to connect the center frame 110 to the sidewall frame 120 in the left-right direction Y of the storage room 20. The rear wall frame 130 may be fixed on the rear wall 22 of the storage room 20.

According to another aspect, the center frame 110 may include a plurality of center frames disposed in the up-down direction Z of the storage room 20. As an example, the center frame 110 may include a first center frame 111 and a second center frame 112 disposed in the up-down direction Z of the storage room 20. The first center frame 111 may be disposed in the upper area in the up-down direction Z of the storage room 20, and the second center frame 112 may be disposed in the lower area in the up-down direction Z of the storage room 20. In this case, the frame 100 may further include a connection frame 140 connecting the first center frame 111 to the second center frame 112. Preferably, the connection frame 140 may connect the first center frame 111 to the second center frame 112 in the up-down direction Z of the storage room 20 in the rear area of the storage room 20.

When the center frame 110 includes the first center frame 111 and the second center frame 112 disposed in the up-down direction Z of the storage room 20, the sidewall frame 120 may also include a first sidewall frame 121 and a second sidewall frame 122 disposed in the up-down direction Z of the storage room 20. Also, the rear wall frame 130 may also include a first rear wall frame 131 and a second rear wall frame 132 disposed in the up-down direction Z of the storage room 20. At this time, the frame 100 may further include a vertical connection frame 150 connecting the first sidewall frame 121 to the second sidewall frame 122. Preferably, the vertical connection frame 150 may connect the first sidewall frame 121 to the second sidewall frame 122 in the up-down direction Z of the storage room 20 in the front area of the storage room 20.

The refrigerator 1 may further include a plurality of accommodating spaces 160. The plurality of accommodating spaces 160 may be formed in the storage room 20. The plurality of accommodating spaces 160 may be partitioned by the center frame 110. According to an example, the plurality of accommodating spaces 160 may include a right accommodating space formed to the right of the center frame 110 and a left accommodating space formed to the left of the center frame 110.

The plurality of accommodating spaces 160 (See FIG. 7A) may include a first space 161 and a second space 162, respectively. The second space 162 may be located behind the first space 161 in the front-rear direction X of the storage room 20.

Figure 5:
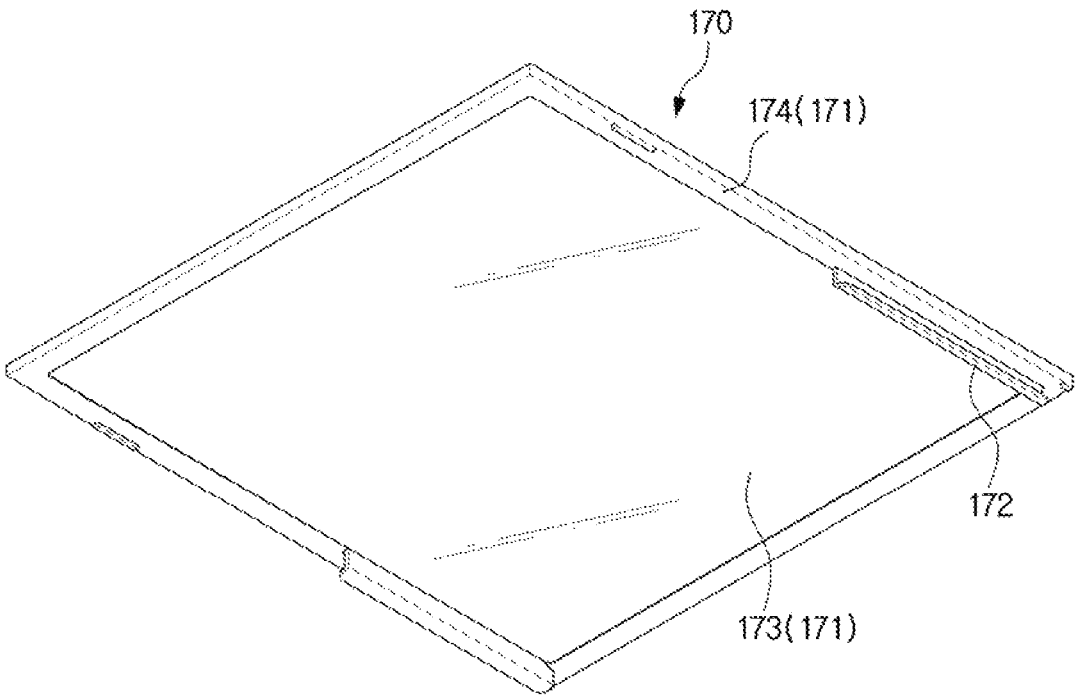
FIG. 5 is a perspective view illustrating the shelves of the refrigerator of FIG. 1.

FIG. 5 is a perspective view illustrating the shelves of the refrigerator of FIG. 1 Hereinafter, reference numerals not denoted in FIG. 5 will be able to be understood from the above description with reference to FIGS. 1 to 4.

As shown in FIG. 5, each shelf 170 may include a shelf body 171. Also, the shelf 170 may further include a catching portion 172. The catching portion 172 may be formed at the edge of the shelf body 171 so as to be coupled with the guide 113 and 123. The catching part 172 may extend in the front-rear direction X of the storage room 20 at a part of the edge of the shelf body 171. In other words, the catching portion 172 may extend in the front-rear direction X of the storage room 20 along a part of the edge of the shelf body 171. The catching portion 172 may be formed at the part of the edge of the shelf body 171 in such a way to face downward in the storage room 20. The catching portion 172 may be formed on the lower surface of the shelf body 171, and have a shape bent outward from the shelf body 171.

More specifically, the shelf body 171 may include a support plate 173 to place food, etc. thereon, and a shelf frame 174 surrounding the edges of the support plate 173. The support plate 173 may be formed of a transparent material, however, the support plate 173 may be formed of any other material. The catching portion 172 may be formed on the shelf frame 174 to be coupled with the guides 113 and 123. The catching portion 172 may extend in the front-rear direction X of the storage room 20 along a part of the shelf frame 174. The catching portion 172 may be formed at a part of the edge of the shelf frame 174 in such a way to face the lower area of the storage room 20. The catching portion 172 may be integrated into the shelf frame 174.

Figure 6:
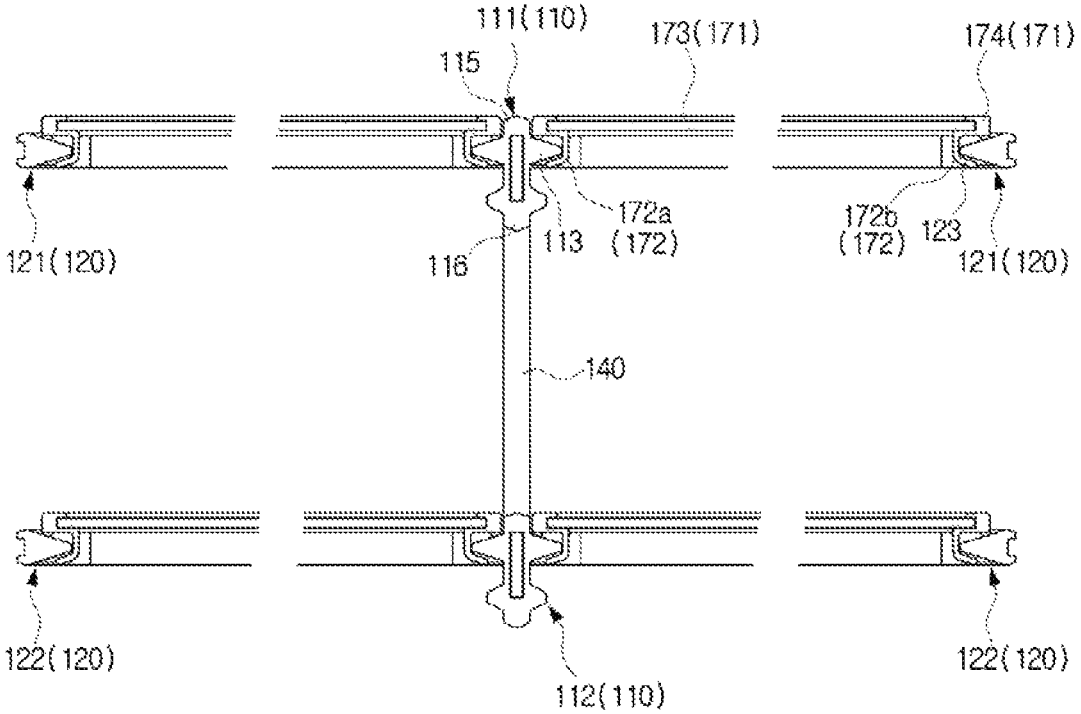
FIG. 6 is a cross-sectional view illustrating the shelves and the frame of FIG. 2, cut along a line C-C' of FIG. 2.

FIG. 6 is a cross-sectional view illustrating the shelves of the refrigerator of FIG. 2 and the frame supporting the shelves, cut along a line C-C' of FIG. 2. Hereinafter, reference numerals not denoted in FIG. 6 will be able to be understood from the above description with reference to FIGS. 1 to 5.

As shown in FIG. 6, the plurality of shelves 170 may be supported by the center frame 110 and the sidewall frame 120 in such a way to be movable in the front-rear direction X of the storage room 20. In other words, the plurality of shelves 170 may be detachably coupled with the guides 113 and 123 in such a way to be movable along the guides 113 and 123. The plurality of shelves 170 may include a first catching portion 172A facing the center frame 110, and a second catching portion 172B facing the sidewall frame 120. The first catching portion 172A may be movably coupled with the guide 113 of the center frame 110, and the second catching portion 1728 may be movably coupled with the guide 123 of the sidewall frame 120. As seen from FIG. 6, the guide 113 may be formed in the support portion 115 positioned above the reinforcing portion 116 in the up-down direction Z of the storage room 20. The reason why the guide 113 is formed in the support portion 115 positioned at a relatively high location is to prevent a convexly protruding partition from being formed between the right shelf and the left shelf. That is, when the guide 113 is formed in the reinforcing portion 116 positioned at a relatively low location, a partition is formed between the right shelf and the left shelf, which may lead to inconvenience when food, etc. are placed on the plurality of shelves 170.

Figure 7A:
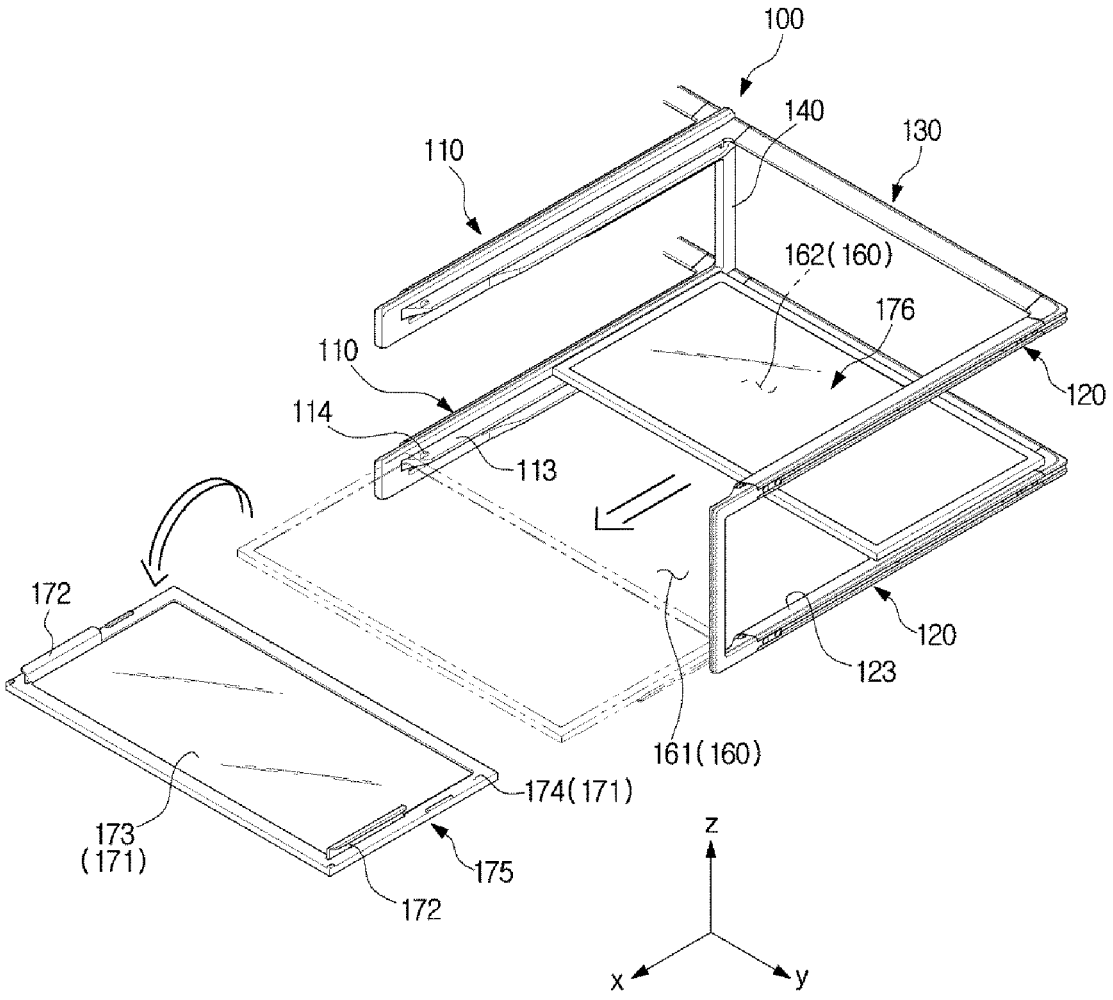
FIGS. 7A and 7B are views for describing a process of positioning a front shelf of the refrigerator of FIG. 1 below a rear shelf.
Figure 7B:
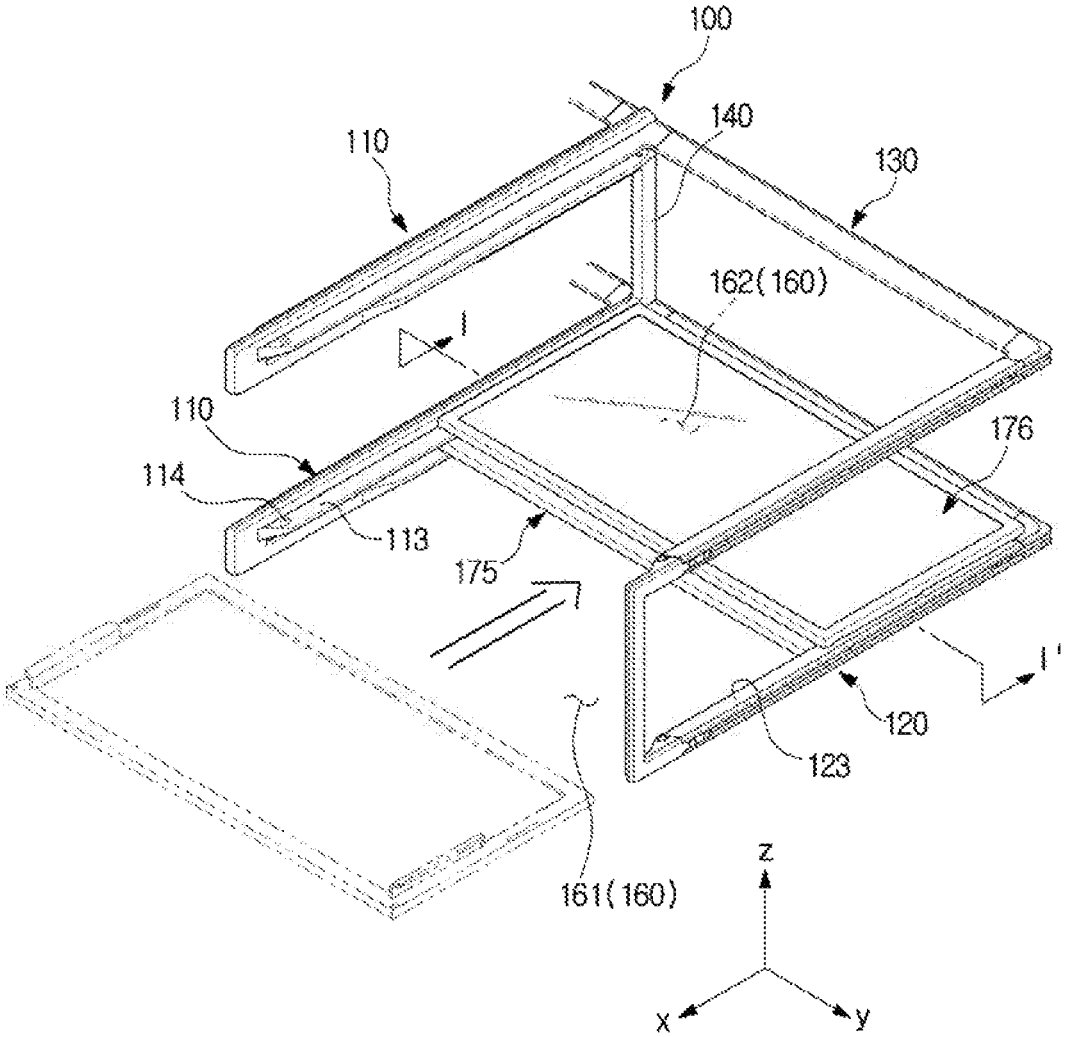
Figure 8:
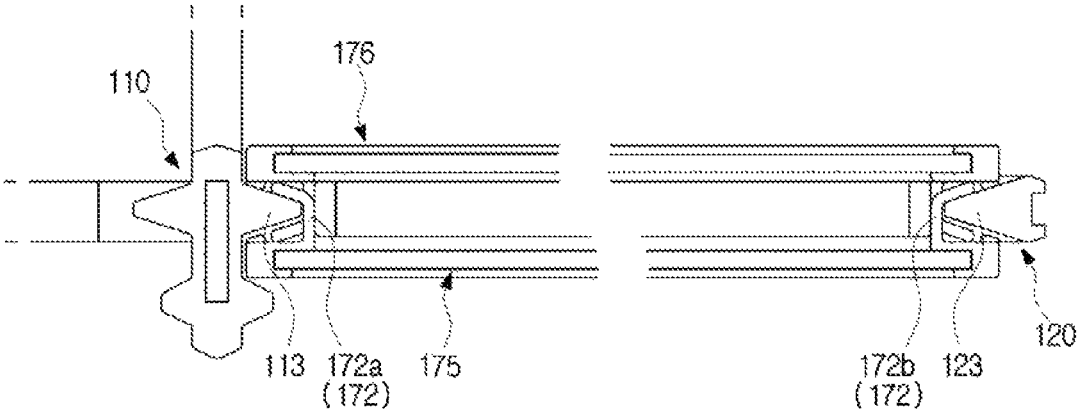
FIG. 8 is a cross-sectional view illustrating the front shelf and the rear shelf of FIG. 7B, cut along a line I-I' of FIG. 7B.

FIGS. 7A and 7B are views for describing a process of positioning a front shelf of the refrigerator of FIG. 1 below a rear shelf, and FIG. 8 is a cross-sectional view illustrating the front shelf and the rear shelf of FIG. 7B, cut along a line I-I' of FIG. 7B. Hereinafter, reference numerals not denoted in FIGS. 7A to 8 will be able to be understood from the above description with reference to FIGS. 1 to 6.

As shown in FIGS. 7A to 8, the plurality of shelves 170 may include a first shelf 175 and a second shelf 176.

The first shelf 175 may be positioned in the first space 161 located in the front area of the storage room 20. The second shelf 176 may be positioned in the second space 162 located behind the first space 161. Hereinafter, the first shelf 175 will be referred to as a front shelf, and the second shelf 176 will be referred to as a rear shelf.

The first shelf 175 may be turned over to open the first space 161, and then move along the same guides 113 and 123 along which the second shelf 176 moves to be located below the second shelf 176. The first shelf 175 may be located in the second space 162 together with the second shelf 176 so that the first space 161 is wide open.

When the first shelf 175 and the second shelf 176 are located in the first space 161 and the second space 162, respectively, the catching portion 172 of the first shelf 175 and the catching portion 172 of the second shelf 176 may all face the lower area of the storage room 20. However, when the first shelf 175 is turned over, the catching portion 172 of the first shelf 175 may face the upper area of the storage room 20. More specifically, when the first shelf 175 is turned over to be positioned below the second shelf 176, the catching portion 172 of the second shelf 176 may face the lower area of the storage room 20, and the catching portion 172 of the first shelf 175 may face the upper area of the storage room 20, so that the catching portion 172 of the first shelf 175 may interfere with the catching portion 172 of the second shelf 176 in the front-rear direction X of the storage room 20 on the guides 113 and 123.

Preferably, when the first shelf 175 and the second shelf 176 are located in the first space 161 and the second space 162, respectively, the catching portion 172 of the first shelf 175 may be located in the rear portion of the first shelf 175, and the catching portion 172 of the second shelf 176 may be located in the rear portion of the second shelf 176. However, when the first shelf 175 is turned over, the catching portion 172 of the first shelf 175 may be located in the front portion of the first shelf 175.

Since the catching portion 172 of the first shelf 175 is formed along a part of the edge of the first shelf 175, and the catching portion 172 of the second shelf 176 is formed along a part of the edge of the second shelf 176, the first shelf 175 may be positioned below the second shelf 176 to open the first space.

As such, when the plurality of shelves 170 can be stacked in the up-down direction Z of the storage room 20, the user can make better use of space of the storage room 20 according to his/her choice.

Another aspect of the present disclosure will be described below.

The plurality of shelves 170 may have various sizes, as shown in FIG. 2. Hereinafter, large ones of the plurality of shelves 170 shown in FIG. 2 will be described. According to an example, the plurality of shelves 170 may include a first shelf positioned to the right of the center frame 110, and a second shelf positioned to the left of the center frame 110. Hereinafter, the first shelf will be referred as a right shelf, and the second shelf will be referred as a left shelf.

The second shelf may be turned over, and move along the same guides 113 and 123 along which the first shelf moves to be located below the first shelf. That is, when the second shelf is taken out of the storage room 20 and then turned over to move along the same guides 113 and 123 along which the first shelf moves toward the rear area of the storage room 20, the second shelf may be positioned below the first shelf so that the left space of the center frame 110 may open. At this time, the catching portion of the first shelf may face the lower area of the storage room 20, and the catching portion of the second shelf may face the upper area of the storage room 20, so that the catching portion of the first shelf may interfere with the catching portion of the second shelf in the front-rear direction X of the storage room 20 on the guides 113 and 123.

Figure 9:
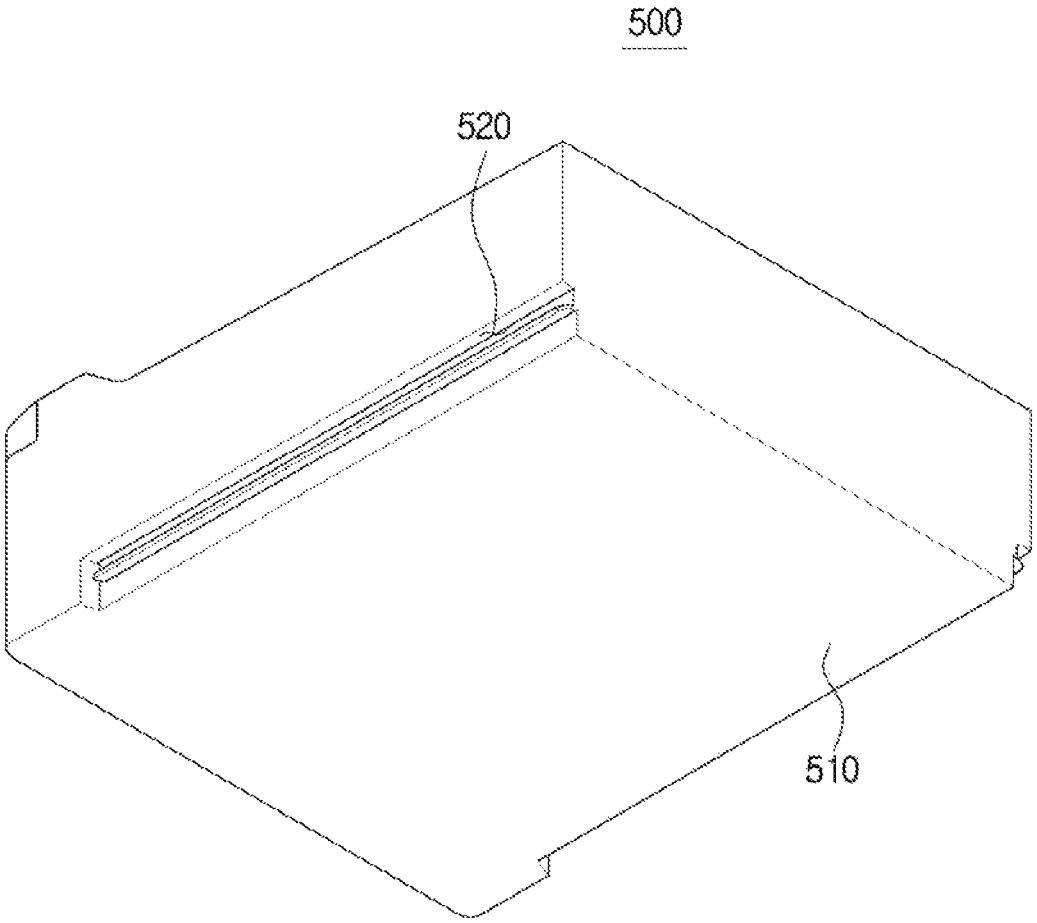
FIG. 9 is a perspective view of a basket in accordance with a first embodiment that can be applied to the refrigerator of FIG. 1.
Figure 10:
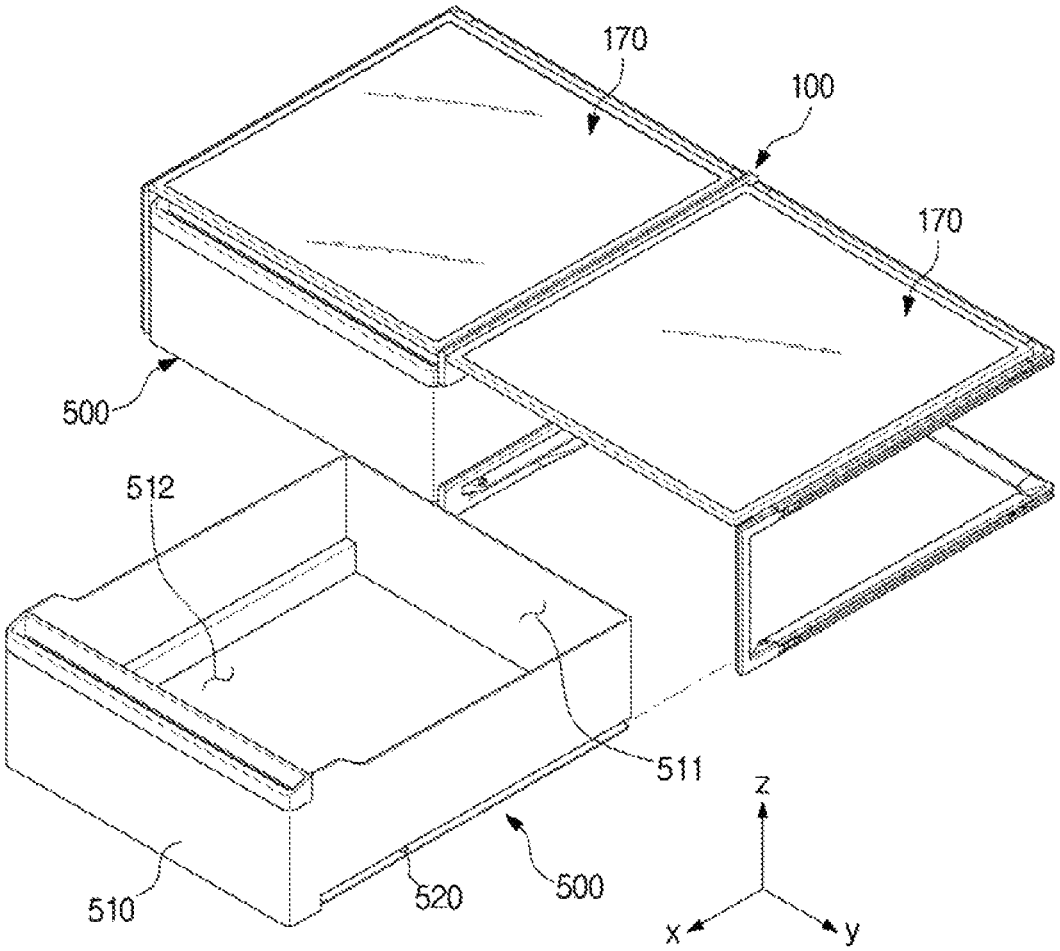
FIG. 10 is a perspective view showing a coupling relationship of the frame of FIG. 3, the shelves of FIG. 5, and the basket in accordance with the first embodiment of FIG. 9.
Figure 11:
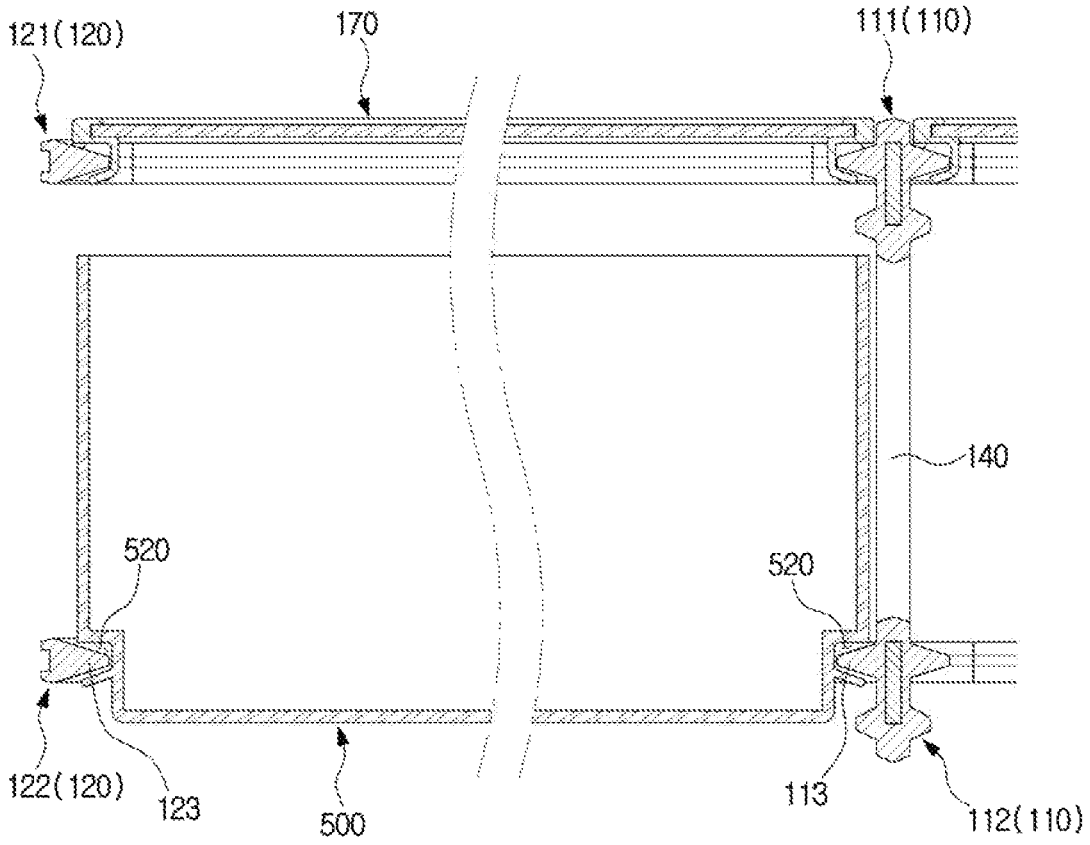
FIG. 11 is a cross-sectional view illustrating a state in which the shelves of FIG. 5 and the basket in accordance with the first embodiment of FIG. 9 are coupled with the frame of FIG. 3.

FIG. 9 is a perspective view illustrating a basket in accordance with a first embodiment that can be applied to the refrigerator of FIG. 1, and FIG. 10 is a perspective view showing a coupling relationship of the frame of FIG. 3, the shelves of FIG. 5, and the basket in accordance with the first embodiment of FIG. 9. FIG. 11 is a cross-sectional view illustrating a state in which the shelves of FIG. 5 and the basket in accordance with the first embodiment of FIG. 9 are coupled to the frame of FIG. 3. Hereinafter, reference numerals not denoted in FIGS. 9, 10, and 11 will be able to be understood from the above description with reference to FIGS. 1 to 8. Hereinafter, a description about the same configuration as that described above with reference to FIGS. 1 to 8 will be omitted.

As shown in FIGS. 9 to 11, the at least one containing member 500, 600, 710, 720, and 730 may be detachably coupled with the guides 113 and 123 so as to be movable along the guides 113 and 123.

The at least one containing member 500, 600, 710, 720 and 730 may include a basket 500.

The basket 500 may include a casing 510 forming the outer appearance. The casing 510 may have an opening 511. The opening 511 may be formed in one side of the casing 510. That is, the casing 510 may be in the shape of a box whose one side is open.

The basket 500 may further include an accommodating space 512 formed in the casing 510 to accommodate food, etc. therein.

The basket 500 may further include a rail 520. The rail 520 may be provided on the outer wall of the casing 510. More specifically, the rail 520 may be provided on the outer wall of the casing 510 so as to be coupled with the guides 113 and 123. The rail 520 may be recessed and extend in the front-rear direction X of the storage room 20 in the outer wall of the casing 510. The rail 520 may be formed at the lower end of the casing 510. Specifically, the rail 520 may be recessed and extend in the front-rear direction X of the storage room 20 at the lower ends of both side walls of the casing 510.

As shown in FIGS. 10 and 11, the plurality of shelves 170 and the plurality of baskets 510 may be detachably coupled with the frame 100. The plurality of shelves 170 may be detachably coupled with the guide 113 of the first center frame 111 in such a way to be movable along the guide 113 of the first center frame 111. The plurality of baskets 500 may be removably coupled with the guide 113 of the second center frame 112 in such a way to be movable along the guide 113 of the second center frame 112. The first center frame 111 may be disposed above the second center frame 112 in the up-down direction Z of the storage room 20. At this time, the opening 511 of the plurality of baskets 500 may be opened or closed by a movement of at least one of the plurality of shelves 170 and the plurality of baskets 500. More specifically, when the plurality of shelves 170 are inserted into the storage room 20 while being coupled with the guide 113 of the first center frame 111, the plurality of baskets 500 are inserted into the storage room 20 while being coupled with the guide 113 of the second center frame 112, and the plurality of shelves 170 may serve as a basket cover covering the opening 511 of the plurality of baskets 500. However, when the plurality of shelves 170 are pulled out of the storage room 20 along the guide 113 of the first center frame 111, or when the plurality of baskets 500 are pulled out of the storage room 20 along the guide 113 of the second center frame 112, the opening 511 of the plurality of baskets 500 may open.

As such, the rail 520 of the plurality of baskets 500 may be recessed and extend in the front-rear direction X of the storage room 20 at the lower end of the casing 510 such that the opening 511 of the casing 510 is adjacent to the plurality of shelves 170, since the plurality of shelves 170 can serve as a cover of the plurality of baskets 500 in some cases.

The plurality of shelves 170 detachably coupled with the guide 113 of the first center frame 111 may seal the opening 511 of the plurality of baskets 500 detachably coupled with the guide 113 of the second center frame 112 to thus form a closed space in the plurality of baskets 500. At this time, a sealing member (not shown) may be disposed in one surface of the plurality of shelves 170 and at least one opening 511 of the plurality of baskets 500 that face each other, in order to seal the accommodating space 512. The sealing member may be formed of an elastic material, such as rubber, silicon and the like.

In the current embodiment, the case in which the plurality of shelves 170 are positioned above the plurality of baskets 500 has been described, however it is also possible that the plurality of baskets 500 are positioned above the plurality of shelves 170. That is, the plurality of baskets 500 may be detachably coupled with the guide 113 of the first center frame 111 in such a way to be movable along the guide 113 of the first center frame 111, and the plurality of shelves 170 may be detachably coupled with the guide 113 of the second center frame 112 in such a way to be movable along the guide 113 of the second center frame 112.

Also, it is possible that the plurality of baskets 500 are disposed in the up-down direction Z of the storage room 20. That is, a part of the plurality of baskets 500 may be detachably coupled with the guide 113 of the first center frame 111 in such a way to be movable along the guide 113 of the first center frame 111, and the other part of the plurality of baskets 500 may be detachably coupled with the guide 113 of the second center frame 112 in such a way to be movable along the guide 113 of the second center frame 112.

Figure 12A:
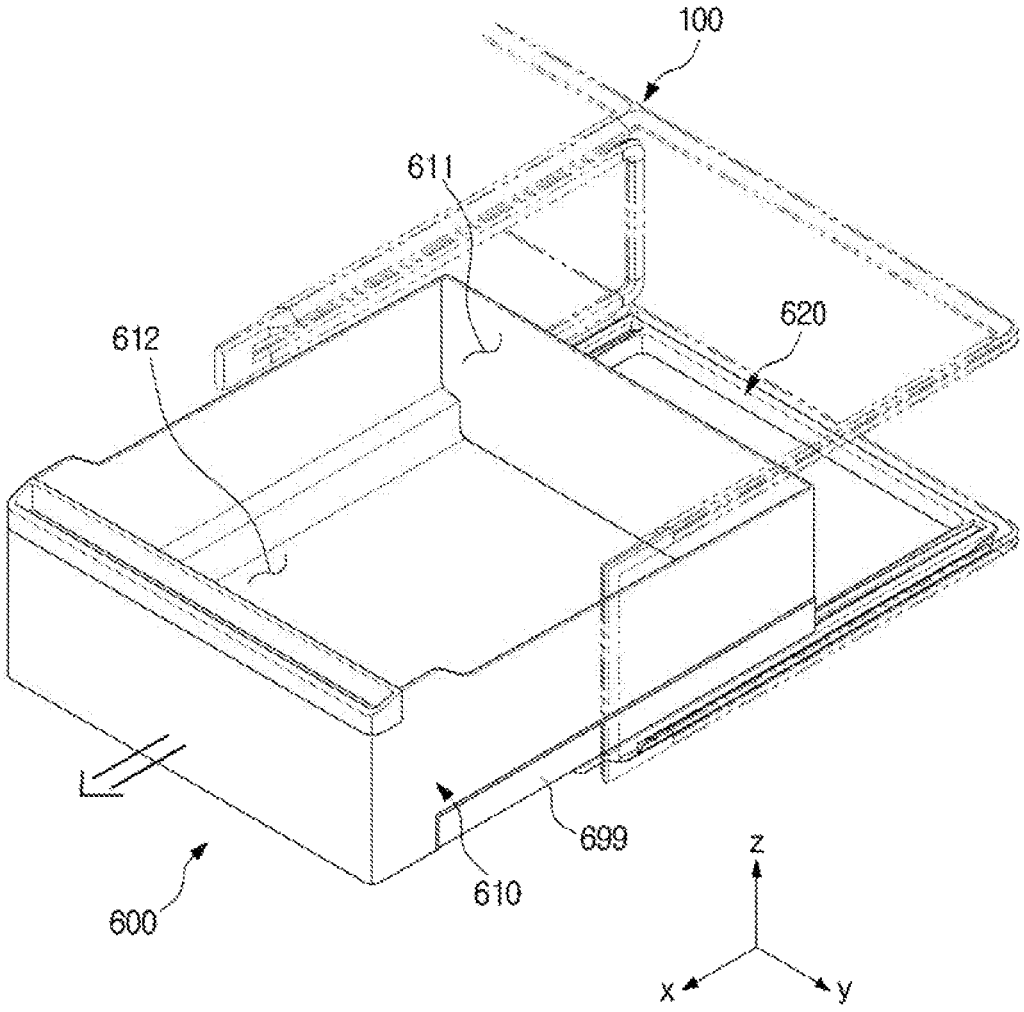
FIGS. 12A and 12B are views for describing the movement of a basket in accordance with a second embodiment that can be applied to the refrigerator of FIG. 1.
Figure 12B:
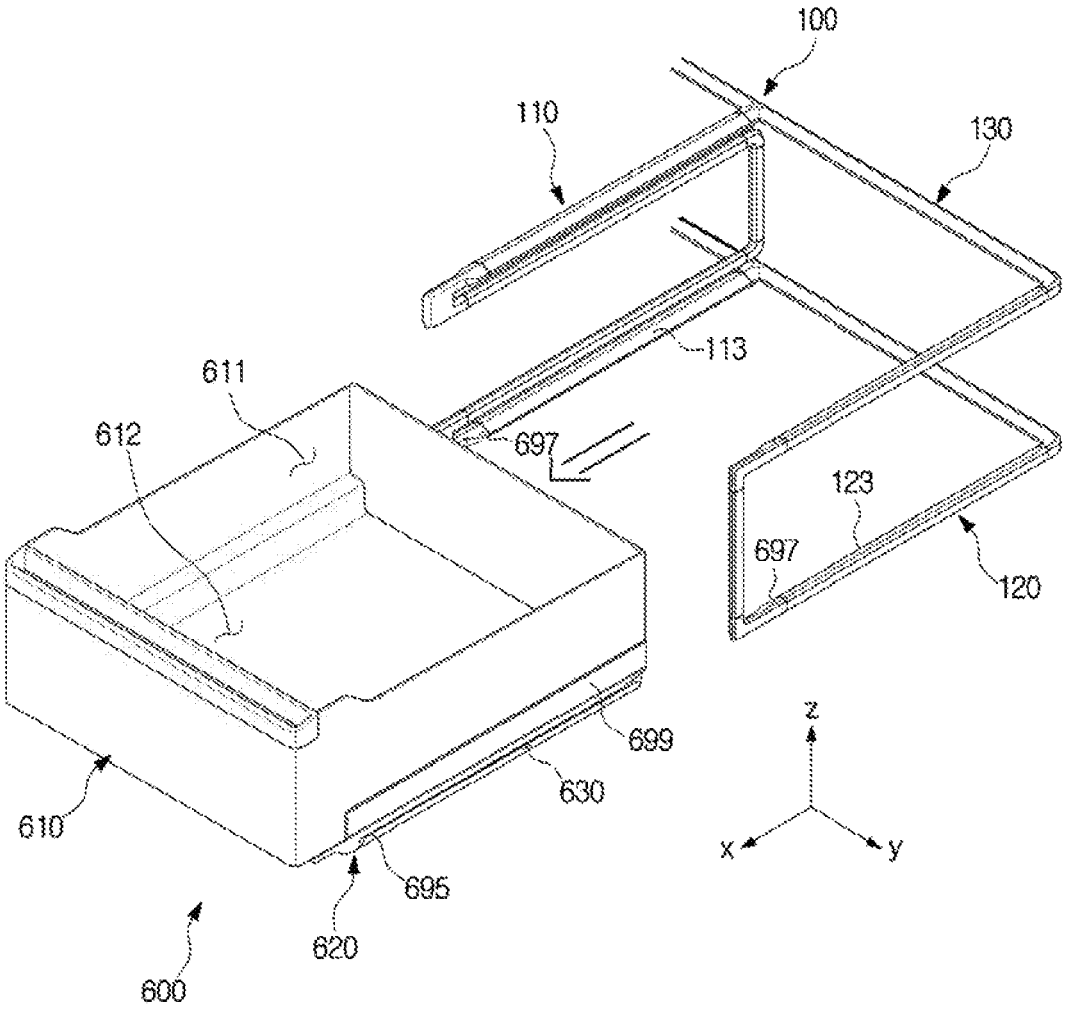
Figure 13:
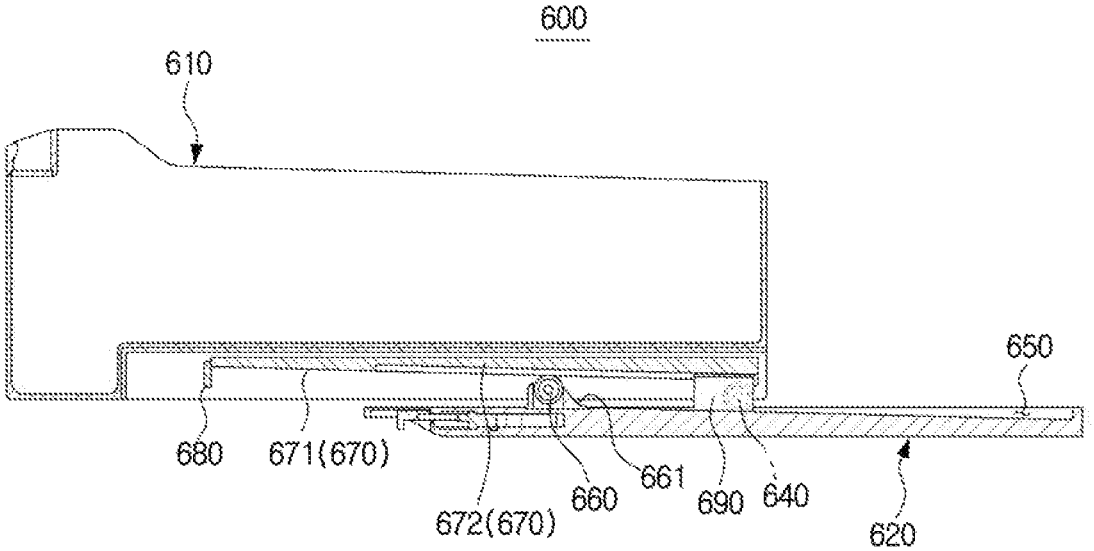
FIG. 13 is a cross-sectional view for describing the movement of the basket in accordance with the second embodiment of FIG. 12A.
Figure 14:
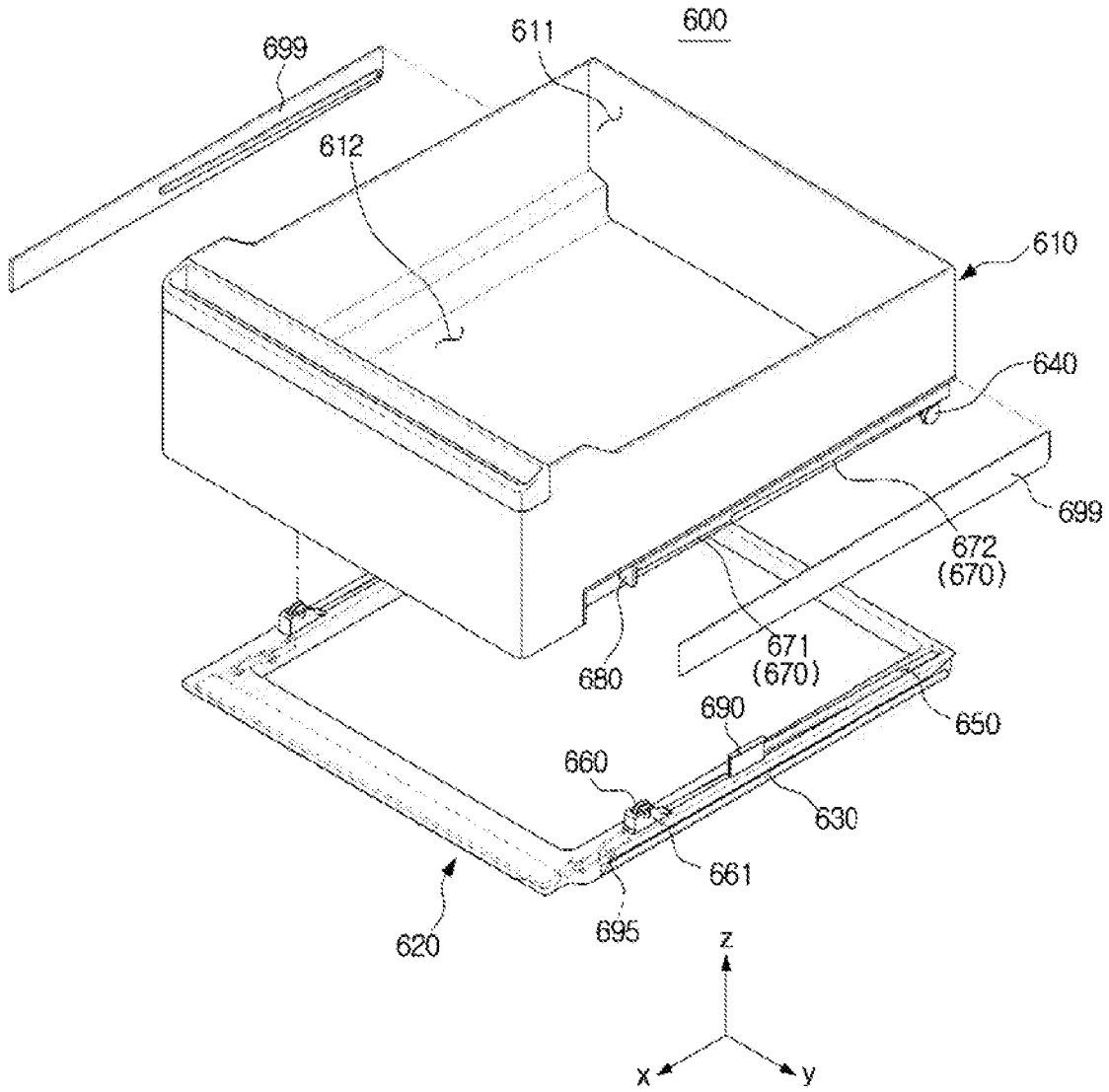
FIG. 14 is an exploded perspective view of the basket according to the second embodiment shown in FIGS. 12A and 12B.

FIGS. 12A and 12B are views for describing the movement of a basket in accordance with a second embodiment that can be applied to the refrigerator of FIG. 1, and FIG. 13 is a cross-sectional view for describing the movement of the basket in accordance with the second embodiment of FIG. 12A. FIG. 14 is an exploded perspective view of the basket according to the second embodiment shown in FIGS. 12A and 12B. Hereinafter, reference numerals not denoted in FIG. 12A to 14 will be able to be understood from the above description with reference to FIGS. 1 to 8. Hereinafter, a description about the same configuration as that described above with reference to FIGS. 1 to 8 will be omitted.

As shown in FIGS. 12A to 14, the at least one containing member 500, 600, 710, 720 and 730 may include a basket 600.

The basket 600 may include a housing 610 forming the outer appearance. The housing 610 may have an opening 611. The opening 611 may be formed in one side of the housing 610. That is, the housing 610 may be in the shape of a box shape whose one side opens.

The basket 600 may further include an accommodating space 612 formed inside the housing 610 to accommodate food, etc. therein.

The basket 600 may further include a support plate 620. The support plate 620 may support the housing 610. The housing 610 may be coupled with the upper surface of the support plate 620 in such a way to be movable in the front-rear direction X of the storage room 20. The support plate 620 may be detachably coupled with the guide 113 and 123 in such a way to be movable in the front-rear direction X of the storage room 20.

The basket 600 may further include a rail 630. The rail 630 may be provided on the side surface of the support plate 620. More specifically, the rail 630 may be provided on the side wall of the support plate 620 to be coupled with the guide 113 and 123. The rail 630 may be recessed and extend in the front-rear direction X of the storage room 20 on the side surface of the support plate 620.

The basket 600 may further include a roller 640. The roller 640 may be rotatably provided on the outer wall of the housing 610. The roller 640 may be provided on the housing 610 in such a way to be movable along a guide rail 650 formed on the support plate 620.

The basket 600 may further include the guide rail 650. The guide rail 650 may be recessed in the support plate 620. More specifically, the guide rail 650 may be recessed in one surface of the support plate 620 that is opposite to the housing 610. The guide rail 650 may extend in the front-rear direction X of the storage room 20 so that the roller 640 can move along the guide rail 650.

The depth of the front end of the guide rail 650 toward the front area of the storage room 20 may be deeper than that of the rear end of the guide rail 650 toward the rear area of the storage room 20. Preferably, the depth of the guide rail 650 may become shallower gradually from front to rear toward the rear area of the storage room 20.

The basket 600 may further include an auxiliary roller 660, and an auxiliary roller housing 661 to accommodate the ancillary roller 660 therein. The auxiliary roller housing 661 may accommodate the auxiliary roller 660 such that a part of the auxiliary roller 660 protrudes toward the housing 610. The auxiliary roller housing 661 may be provided on the support plate 620. The auxiliary roller housing 661 may be disposed on the front portion of the support plate 620. The auxiliary roller housing 661 may serve as a "stopper" for restricting a movement of the housing 610 toward the front area of the storage room 20. More specifically, the auxiliary roller housing 661 may interfere with a movement of the roller 640 to restrict the movement of the housing 610 toward the front area of the storage room 20. More specifically, the rear surface of the auxiliary roller housing 661 may function as a catching jaw blocking the movement of the roller 640 to restrict the movement of the housing 610 toward the front area of the storage room 20.

The basket 600 may further include an auxiliary roller guide 670. The auxiliary roller guide 670 may be provided on the housing 610. More specifically, the auxiliary roller guide 670 may be formed on the outer wall of the housing 610 in such a way to extend in the front-rear direction X of the storage room 20. The height of the front end of the auxiliary roller guide 670 toward the front area of the storage room 20 may be higher than that of the rear end of the auxiliary roller guide 670 toward the rear area of the storage room 20. That is, the front end of the auxiliary roller guide 670 toward the front area of the storage room 20 may be located above the rear end of the auxiliary roller guide 670 toward the rear area of the storage room 20. Preferably, the height of the auxiliary roller guide 670 may be gradually lowered toward the rear end of the auxiliary roller guide 670 toward the rear area of the storage room 20.

The auxiliary roller guide 670 may include a first portion 671 located toward the front area of the storage room 20. The auxiliary roller 660 may be in contact with the first portion 671 of the auxiliary roller guide 670 when passing through the first portion 671 of the auxiliary roller guide 670.

The auxiliary roller guide 670 may further include a second portion 672 located toward the rear area of the storage room 20. The second portion 672 may be connected to the first portion 671 in such a way to form a step with respect to the first portion 671. The auxiliary roller 660 may pass through the second portion 672 of the auxiliary roller guide 670 while being spaced from the second portion 672 of the auxiliary roller guide 670.

The basket 600 may further include a front stopper 680. The front stopper 680 may be provided on the housing 610. More specifically, the front stopper 680 may be provided on the outer wall of the housing 610 to be positioned in the front portion of the auxiliary roller guide 670. The front stopper 680 may function to restrict the movement of the housing 610 toward the rear area of the storage room 20. More specifically, the front stopper 680 may interfere with the auxiliary roller housing 661 to restrict the movement of the housing 610 toward the rear area of the storage room 20. More specifically, the front stopper 680 may interfere with the front surface of the auxiliary roller housing 661.

The basket 600 may further include a support portion 690. The support portion 690 may be disposed on the support plate 620 to protrude toward the housing 610. The support portion 690 may move along the second portion 672 of the auxiliary roller guide 670. The support portion 690 may move along the second portion 672 of the auxiliary roller guide 670 while contacting the second portion 672 of the auxiliary roller guide 670.

The basket 600 may further include a protrusion 695. The protrusion 695 may be provided on the support plate 620 to protrude toward the center frame 110 or the sidewall frames 120. The protrusion 695 may participate in locking of the support plate 620. More specifically, the guide 113 of the center frame 110 and the guide 123 of the sidewall frames 120 may be provided with a protrusion groove 697. The protrusion 695 may be provided on the support plate 620 so as to be coupled with protrusion groove 697. When the protrusion 695 is coupled with the protrusion groove 697, the support plate 620 may is locked to be fixed between the center frame 110 and the sidewall frames 120. When the protrusion 695 is separated from the protrusion groove 697, the support plate 620 may be released to be movable along the guide 113 of the center frame 110 and the guide 123 of the sidewall frames 120 in the front-rear direction X of the storage room 20.

The basket 600 may further include a cover 699. The cover 699 may be coupled with the outer wall of the housing 610 to prevent components (for example, the roller 640, the auxiliary roller guide 670, the front stopper 680, etc.) participating in the movement of the housing 610 from being exposed to the outside.

Hereinafter, a movement of the basket 600 according to the second embodiment will be described. The basket 600 may be movable in the front-rear direction X of the storage room 20 along the guide 113 of the center frame 110 and the guide 123 of the sidewall frames 120. At this time, the basket 600 may be detachable from the guide 113 of the center frame 110 and the guide 123 of the sidewall frame 120. Since the rail 630 coupled with the guide 113 of the center frame 110 and the guide 123 of the sidewall frames 120 is formed on the support plate 620 of the basket 600, the housing 610 and the support plate 620 may be separated together from the guide 113 of the center frame 110 and the guide 123 of the sidewall frames 120 when the support plate 620 is separated from the guide 113 of the center frame 110 and the guide 123 of the sidewall frames 123. The basket 600, specifically, the support plate 620 may be locked to the guide 113 of the center frame 110 and the guide 123 of the sidewall frame 120 when the protrusion 695 is coupled with the protrusion groove 697. The locked state may be released when the user applies a force that is stronger than a coupling force between the projection 695 and the projection groove 697, to the basket 600.

The housing 610 can move in the front-rear direction X of the storage room 20 on the support plate 620, separately from the support plate 620. More specifically, the housing 610 can move in the front-rear direction X of the storage room 20 on the support plate 620 in the state in which it is coupled to the support plate 620. The housing 610 may be pulled out toward the front area of the storage room 20 until the roller 640 interferes with the auxiliary roller housing 661, and the housing 610 may be pulled in toward the rear area of the storage room 20 until the front stopper 680 interferes with the auxiliary roller housing 661.

Figure 15A:
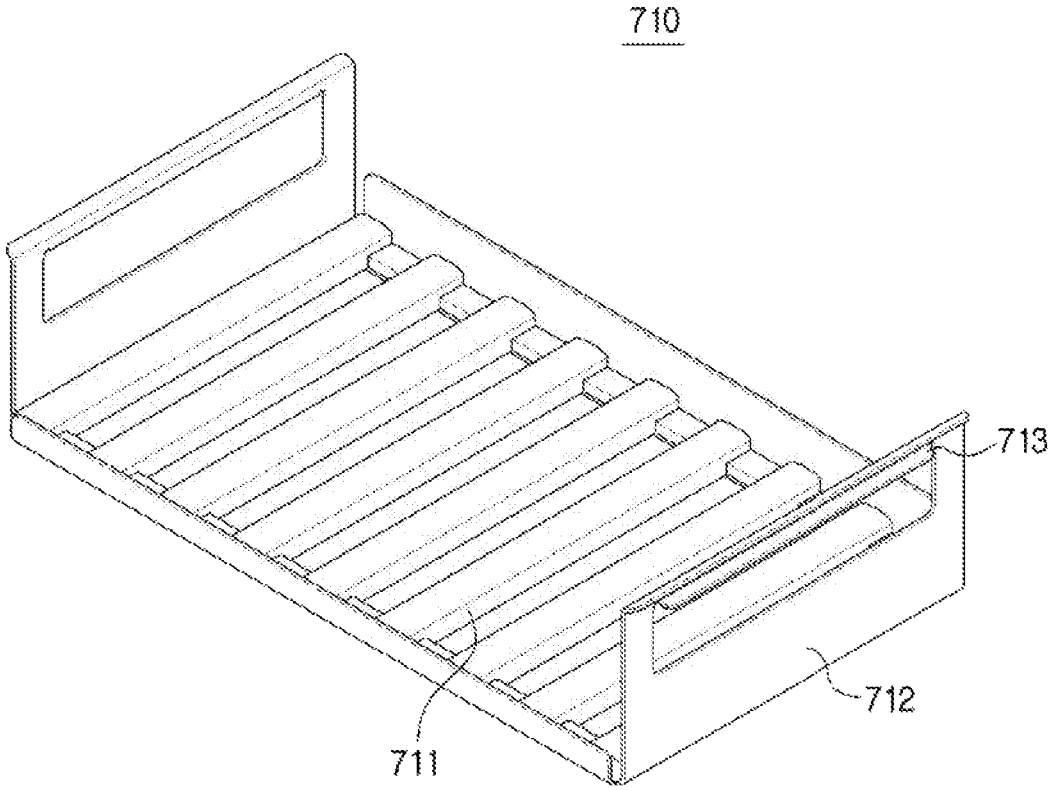
FIGS. 15A to 15C are perspective views illustrating various containing members that can be applied to the refrigerator of FIG. 1.
Figure 15B:
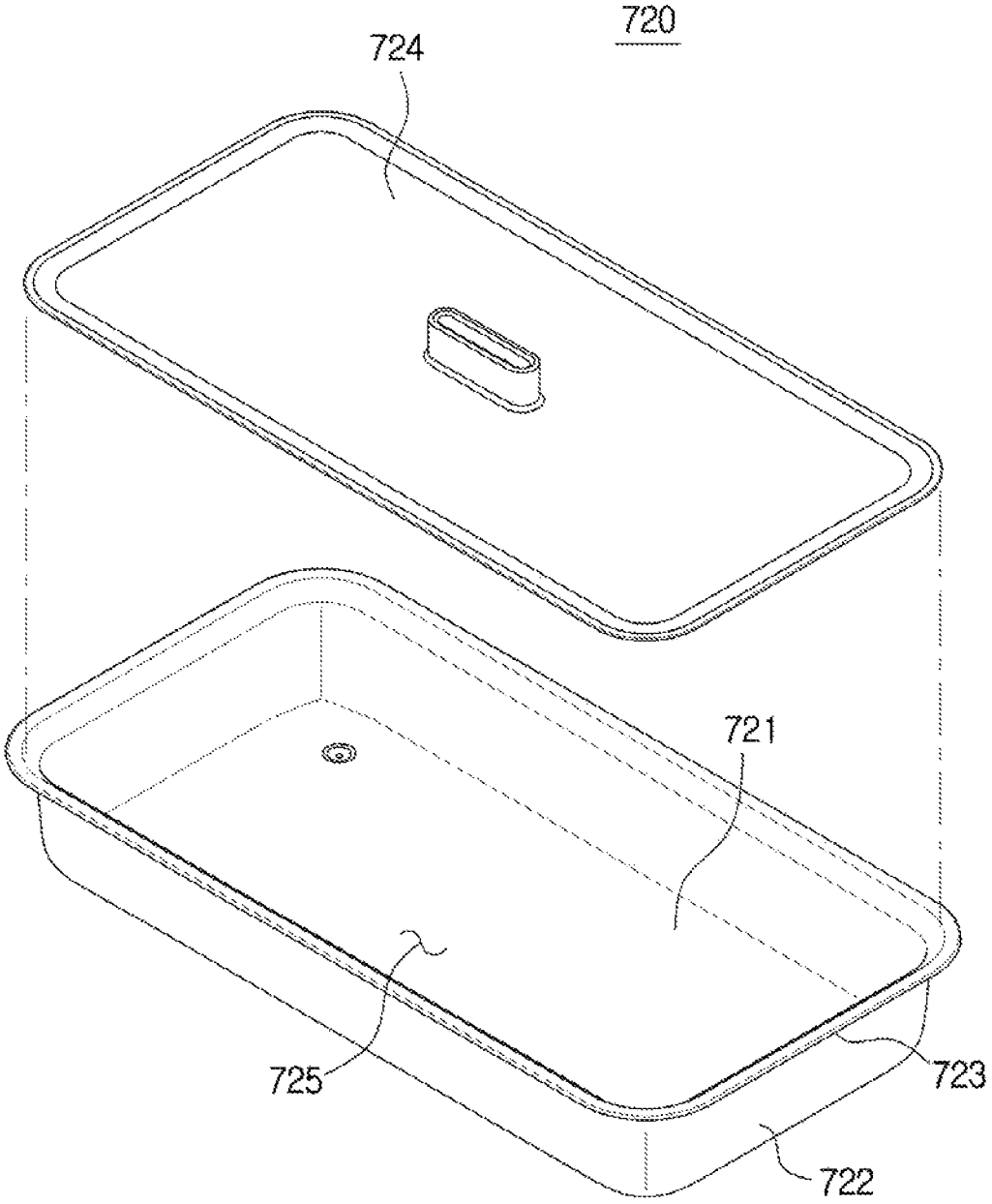
Figure 15C:
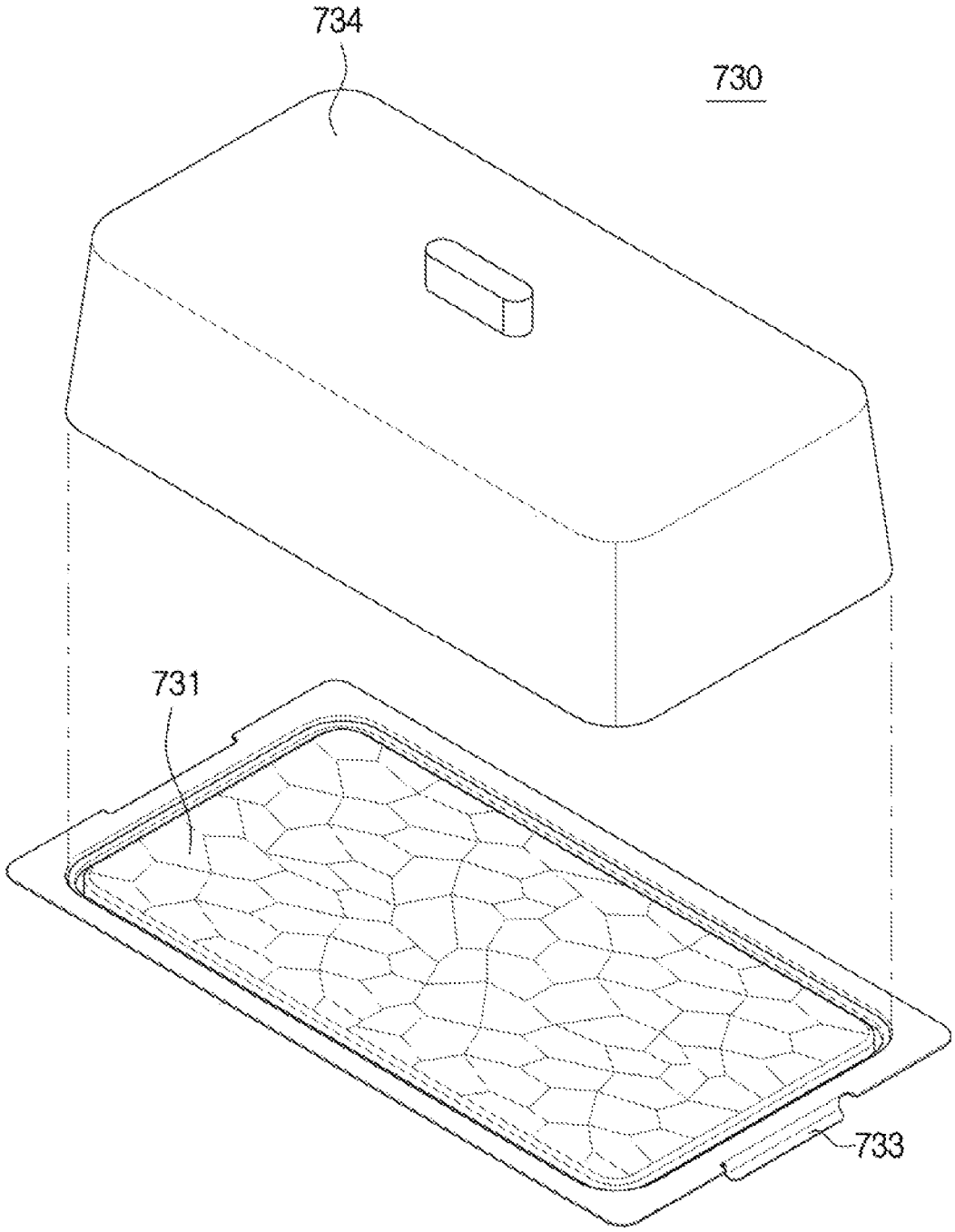

FIGS. 15A to 15C are perspective views illustrating various containing members that can be applied to the refrigerator of FIG. 1 Hereinafter, reference numerals not denoted in FIGS. 15A to 15C will be able to be understood from the above description with reference to FIGS. 1 to 8. Hereinafter, a description about the same configuration as that described above with reference to FIGS. 1 to 8 will be omitted.

As shown in FIGS. 15A to 15C, the at least one containing member 500, 600, 710, 720 and 730 may include various types of containing trays 710, 720 and 730.

As shown in FIG. 15A, the containing tray 710 may include a bottom plate 711 to place food, etc. thereon. Also, the containing tray 710 may include a side wall 712 bent from the bottom plate 711 and extending to have a predetermined height. The side wall 712 may be formed along a part of the edge of the bottom plate 711. A plurality of side walls 712 may face each other. The side wall 712 may be provided with a catching portion 713 that is coupled with the guide 113 of the center frame 110 and the guide 123 of the sidewall frames 120. Preferably, the catching portion 713 may be integrated into the side wall 712 at the upper end of the side wall 712.

As shown in FIG. 15B, the containing tray 720 may include a bottom plate 721 to place food, etc. thereon. Also, the containing tray 720 may include a side wall 722 bent from the bottom plate 721 and extending to have a predetermined height. The side wall 722 may be formed along the edge of the bottom plate 721, and be in the shape of a substantially box forming a storage space thereinside. The side wall 722 may include a mounting portion 723 protruding outward from the containing tray 720 so as to be supported on the guide 113 of the center frame 110 and the guide 123 of the sidewall frames 120. The mounting portion 723 may be supported on the guide 113 of the center frame 110 and the guide 123 of the sidewall frame 120. The mounting portion 723 may be integrated into the side wall 722 at the upper end of the side wall 722. The containing tray 720 may further include a containing tray cover 724.

As shown in FIG. 15C, the containing tray 730 may include a bottom plate 731 to place food, etc. thereon. The bottom plate 731 may include a catching portion 733 that is coupled with the guide 113 of the center frame 110 and the guide 123 of the sidewall frame 120. Preferably, the catching portion 733 may be integrated into the bottom plate 731 at the edge of the bottom plate 731. The containing tray 730 may further include a containing tray cover 734.

The configuration of the plurality of shelves 170 and the at least one containing member 500, 600, 710, 720 and 730 described above may be changed in various manners according to the user's choice.

Figure 16:
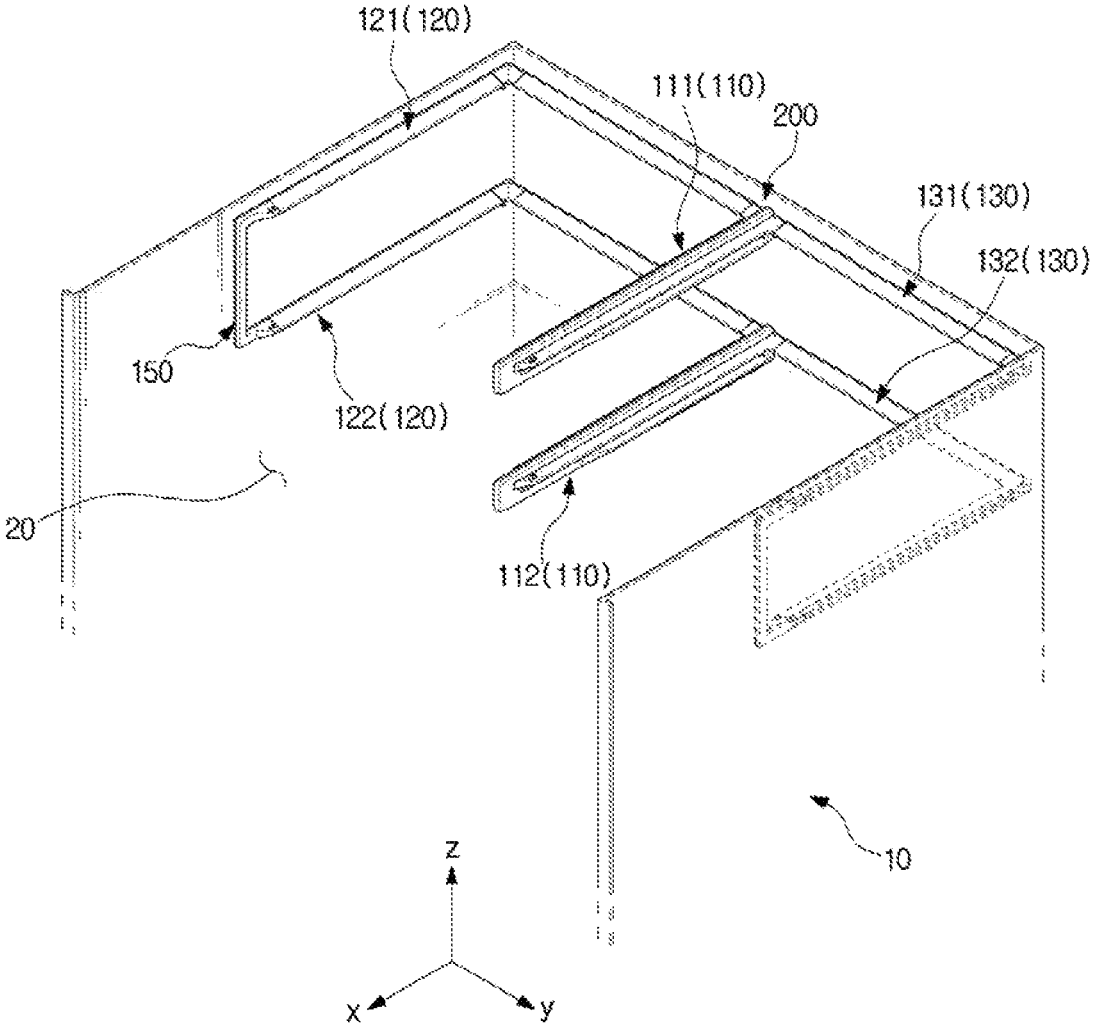
FIG. 16 shows a frame installed in the refrigerator in accordance with another embodiment of the disclosure.

FIG. 16 shows a frame installed in the refrigerator in accordance with another embodiment of the disclosure. Hereinafter, reference numerals not denoted in FIG. 16 will be able to be understood from the above description with reference to FIGS. 1 to 4. Hereinafter, a description about the same configuration as that described above with reference to FIGS. 1 to 4 will be omitted.

As shown in FIG. 16, a frame 200 may include the first center frame 111, the second center frame 112, the first sidewall frame 121, the second sidewall frame 122, the first rear wall frame 131, the second rear wall frame 132, the connection frame 140, and the vertical connection frame 150.

Also, the frame 200 may include the first center frame 111, a second center frame 112, a first sidewall frame 121, and a second sidewall frame 122.

Figure 17:
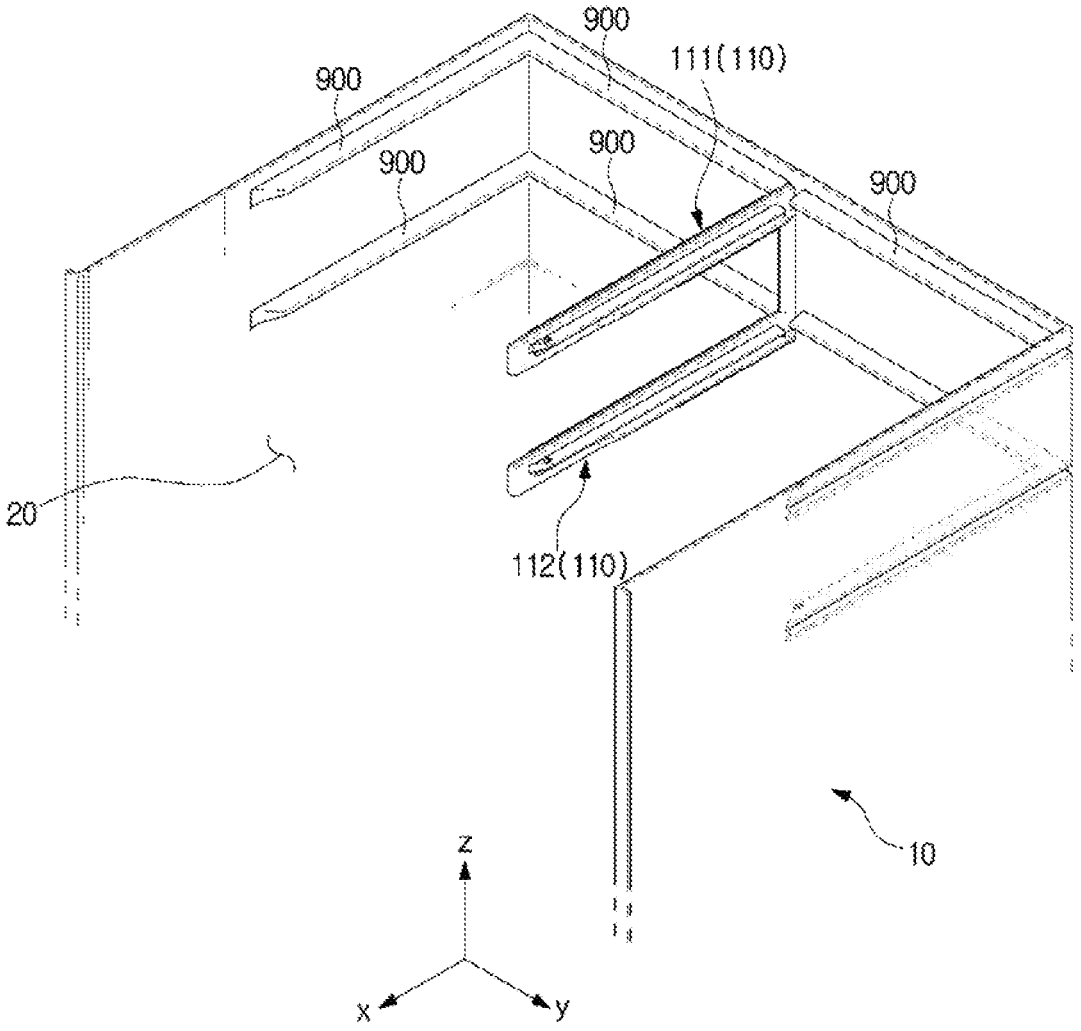
FIG. 17 shows a frame installed in the refrigerator in accordance with still another embodiment of the disclosure.

FIG. 17 shows a frame installed in the refrigerator in accordance with still another embodiment of the disclosure. Hereinafter, reference numerals not denoted in FIG. 17 will be able to be understood from the above description with reference to FIGS. 1 to 4. Hereinafter, a description about the same configuration as that described above with reference to FIGS. 1 to 4 will be omitted.

As shown in FIG. 17, the refrigerator may further include a bead 900. The bead 900 may protrude from both side walls 21 of the storage room 20 to correspond to the center frame 110, and guide a movement of the plurality of shelves 170 or the at least one containing member 500, 600, 710, 720 and 730 together with the guide 113 of the center frame 110. At this time, the bead 900 may replace the sidewall frames 120. Also, the bead 900 may protrude from the rear wall 22 of the storage room 20, and replace the rear wall frame 130.

Although a few embodiments of the present disclosure have been shown and described, it would be appreciated by those skilled in the art that changes may be made to the embodiments without departing from the principles and spirit of the invention, the scope of which is defined in the claims and their equivalents.

By providing a frame inside the storage room to enable a user to arrange the shelves or the containing members freely, it is possible to make better use of space of the storage room.

By forming the catching portion on the shelves or the containing members, the shelves or the containing members can move freely along the guide formed in the center frame.

By forming the rail in the basket, the basket can move freely along the guide formed in the center frame.

By designing the shelves or the containing members to be movable along the guide, the shelves or the containing trays can be easily attached and detached.

Since the shelves can be stacked vertically in the storage room, it is possible to make better use of space of the storage room according to the user's choice.

What is claimed is:

1. A refrigerator, comprising:

a main body;

a storage room formed inside the main body and having side walls and a rear wall;

a center frame disposed at a center of the storage room to be spaced apart from the side walls of the storage room, the center frame having a guide extending in a front-rear direction of the storage room; and a plurality of shelves detachably coupled with the guide and movable along the guide, the plurality of shelves including a first shelf, and a second shelf positioned behind the first shelf in the front-rear direction of the storage room, wherein each of the first shelf and the second shelf comprises a shelf body, and a catching portion formed at the shelf body to be coupled with the guide and facing a bottom portion of the storage room, and wherein the first shelf is movable along the guide to be positioned below the second shelf in a state in which the first shelf is turned over so that the catching portion of the first shelf faces an upper portion of the storage room.

2. The refrigerator according to claim 1, wherein the catching portion is formed at a part of an edge of the shelf body, and extends in the front-rear direction of the storage room.

3. The refrigerator according to claim 1, wherein when the first shelf and the second shelf are positioned in the front-rear direction of the storage room so that the catching portion of the first shelf and the catching portion of the second shelf face the bottom portion of the storage room, the catching portion of the first shelf is located in a rear portion of the shelf body of the first shelf and the catching portion of the second shelf is located in a rear portion of the shelf body of the second shelf.

4. The refrigerator according to claim 1, wherein when the first shelf is positioned below the second shelf in the state in which the first shelf is turned over, the catching portion of the first shelf is located in a front portion of the shelf body of the first shelf and the catching portion of the second shelf is located in a rear portion of the shelf body of the second shelf.

5. The refrigerator according to claim 1, wherein when the first shelf is positioned below the second shelf in the state in which the first shelf is turned over, the catching portion of the first shelf interferes with the catching portion of the second shelf on the guide in the front-rear direction of the storage room.

6. The refrigerator according to claim 1, wherein the center frame comprises a support portion in which the guide is formed, and a reinforcing portion connected to the support portion to reinforce the support portion.

7. The refrigerator according to claim 6, wherein the guide protrudes from the support portion toward the side walls of the storage room.

8. The refrigerator according to claim 1, wherein the guide includes a stopper provided to restrict a movement of the plurality of shelves.

9. The refrigerator according to claim 1, further comprising a plurality of sidewall frames disposed on the side walls of the storage room so that the center frame is disposed between the plurality of sidewall frames, and respectively having a guide protruding toward the center frame to guide a movement of the plurality of shelves together with the guide of the center frame.

10. The refrigerator according to claim 9, further comprising a rear wall frame disposed on the rear wall of the storage room, and configured to connect the center frame to the plurality of sidewall frames in a left-right direction of the storage room.

* * * * *